US010562174B2

(12) United States Patent
Omry et al.

(10) Patent No.: US 10,562,174 B2
(45) Date of Patent: Feb. 18, 2020

(54) WORKBENCH

(71) Applicant: Stanley Black & Decker, Inc., New Britain, CT (US)

(72) Inventors: Adar Omry, Tel Aviv (IL); Abraham Faibish, Jerusalem (IL); Mickey Menirom, Raanana (IL); Miki Birnbaum, Rehovat (IL); Shalom Saigauvker, Rosh Ha'ayin (IL); Robbie Tzemach, Rosh Ha'Ayin (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 15/967,922

(22) Filed: May 1, 2018

(65) Prior Publication Data

US 2019/0001481 A1 Jan. 3, 2019

Related U.S. Application Data

(63) Continuation of application No. PCT/US2016/061619, filed on Nov. 11, 2016.

(60) Provisional application No. 62/254,141, filed on Nov. 11, 2015.

(51) Int. Cl.

| | |
|---|---|
| ***B25H 1/04*** | (2006.01) |
| ***A47B 3/08*** | (2006.01) |
| ***A47B 3/10*** | (2006.01) |

(52) U.S. Cl.

CPC ..... *B25H 1/04* (2013.01); *A47B 3/08* (2013.01); *A47B 3/10* (2013.01)

(58) Field of Classification Search

CPC ..... A47B 9/16; A47B 3/0818; B25H 1/04; B25H 1/02

USPC ..... 108/115, 127, 128, 129, 130, 131, 132, 108/147, 145, 146

See application file for complete search history.

(56) References Cited

U.S. PATENT DOCUMENTS

| | | | | |
|---|---|---|---|---|
| 363,389 A | | 5/1887 | Hayward | |
| 3,134,142 A | * | 5/1964 | Canner | B22D 17/22 108/115 |
| 4,155,386 A | | 5/1979 | Alessio | |
| 4,625,657 A | * | 12/1986 | Little | A47B 21/0314 108/138 |
| 4,747,353 A | * | 5/1988 | Watt | A47B 9/02 108/145 |
| 4,850,563 A | | 7/1989 | Grout | |
| 5,383,977 A | | 1/1995 | Pearce | |
| 5,657,974 A | | 8/1997 | Williams | |
| 5,816,374 A | | 10/1998 | Hsien | |
| 6,168,227 B1 | * | 1/2001 | Lofting | B60S 9/02 108/132 |

(Continued)

FOREIGN PATENT DOCUMENTS

| | | |
|---|---|---|
| CA | 277472 A | 1/1928 |
| DE | 202007013446 | 12/2007 |

(Continued)

*Primary Examiner* — Jose V Chen
(74) *Attorney, Agent, or Firm* — Bruce S. Shapiro

(57) ABSTRACT

A workbench includes a work support structure, a first leg member, a second leg member, a handle; and a rack and pinion system coupling the first leg, the second leg, and the handle. Moving the handle relative to the work support structure causes both the first leg member and the second leg member to extend from or retract into the work support structure via movement in the rack and pinion system.

20 Claims, 22 Drawing Sheets

(56) References Cited

U.S. PATENT DOCUMENTS

| | | | | |
|---|---|---|---|---|
| 6,659,440 | B2 * | 12/2003 | Levy | B25H 1/04 269/100 |
| 7,418,907 | B2 | 9/2008 | Haimoff | |
| 7,458,403 | B2 | 12/2008 | Radermacher | |
| 7,891,903 | B2 | 2/2011 | Klingenberg | |
| 8,231,119 | B2 | 7/2012 | Marshall et al. | |
| 10,085,550 | B1 * | 10/2018 | Hsu | A47B 9/16 |
| 10,092,089 | B1 * | 10/2018 | Yuan | A47B 9/16 |
| 2005/0140119 | A1 | 6/2005 | Wong | |
| 2007/0102892 | A1 * | 5/2007 | Chiu | B25H 1/04 280/35 |
| 2011/0023758 | A1 * | 2/2011 | Overgaard | A47B 9/06 108/147 |
| 2015/0272316 | A1 | 10/2015 | Flaherty | |
| 2016/0368131 | A1 | 12/2016 | Ursell et al. | |
| 2018/0255919 | A1 * | 9/2018 | Swartz | A47B 9/02 |

FOREIGN PATENT DOCUMENTS

| | | | |
|---|---|---|---|
| DE | 102007049698 | | 4/2009 |
| DE | 202009014342 | | 3/2011 |
| DE | 202010016824 | | 4/2011 |
| DE | 202012000464 | | 4/2012 |
| DE | 202013000394 | | 5/2013 |
| EP | 0098101 | | 1/1984 |
| EP | 0266172 | | 5/1998 |
| EP | 1238762 | | 9/2002 |
| EP | 1958737 | | 8/2008 |
| WO | 20000043708 | A1 | 7/2000 |
| WO | 2004050309 | | 6/2004 |
| WO | 2007073734 | | 7/2007 |
| WO | 2011025952 | | 3/2011 |

* cited by examiner

WORKBENCH

CROSS-REFERENCE TO RELATED APPLICATIONS

This application is a continuation application of PCT/US2016/061619, filed Nov. 11, 2016 which claims priority to U.S. Provisional Patent Application Serial No. 62/254,141, filed Nov. 11, 2015, both of which are incorporated by reference in their entirety.

FIELD OF THE INVENTION

This application relates to workbenches for work facilitation, where the workbenches elevate workpieces for cutting, sawing, drilling, fastening, or other such work.

BACKGROUND OF THE INVENTION

Carpenters, woodworkers and handymen who work with wood as well as other materials, often need a work bench or table which may be utilized to hold or support workpieces. Ordinarily, these work benches include a frame and a table surface connected to the frame. These tables may be versatile, may provide for secure damping, and may be compact and adjustable. For example, one such workbench is disclosed in U.S. Pat. No. 4,155,386, incorporated herein by reference in its entirety.

SUMMARY OF THE INVENTION

According to an embodiment, a workbench includes a work support structure, a first leg member, a second leg member, a handle; and a rack and pinion system coupling the first leg, the second leg, and the handle. Moving the handle relative to the work support structure causes both the first leg member and the second leg member to extend from or retract into the work support structure via movement in the rack and pinion system.

BRIEF DESCRIPTION OF THE DRAWINGS

Embodiments of the invention will now be described by way of example with reference to the drawings in which.

DETAILED DESCRIPTION OF THE INVENTION

Figure 1B:
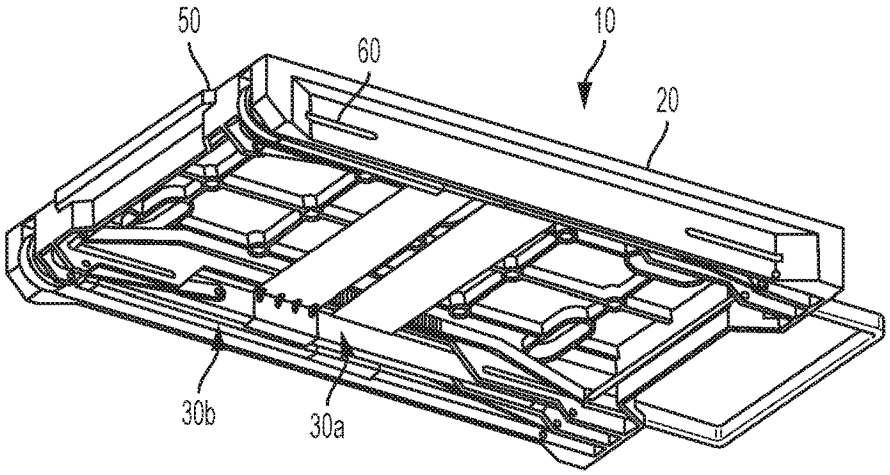
FIGS. 1A and 1B illustrate a first embodiment of a foldable workbench.
Figure 1A:
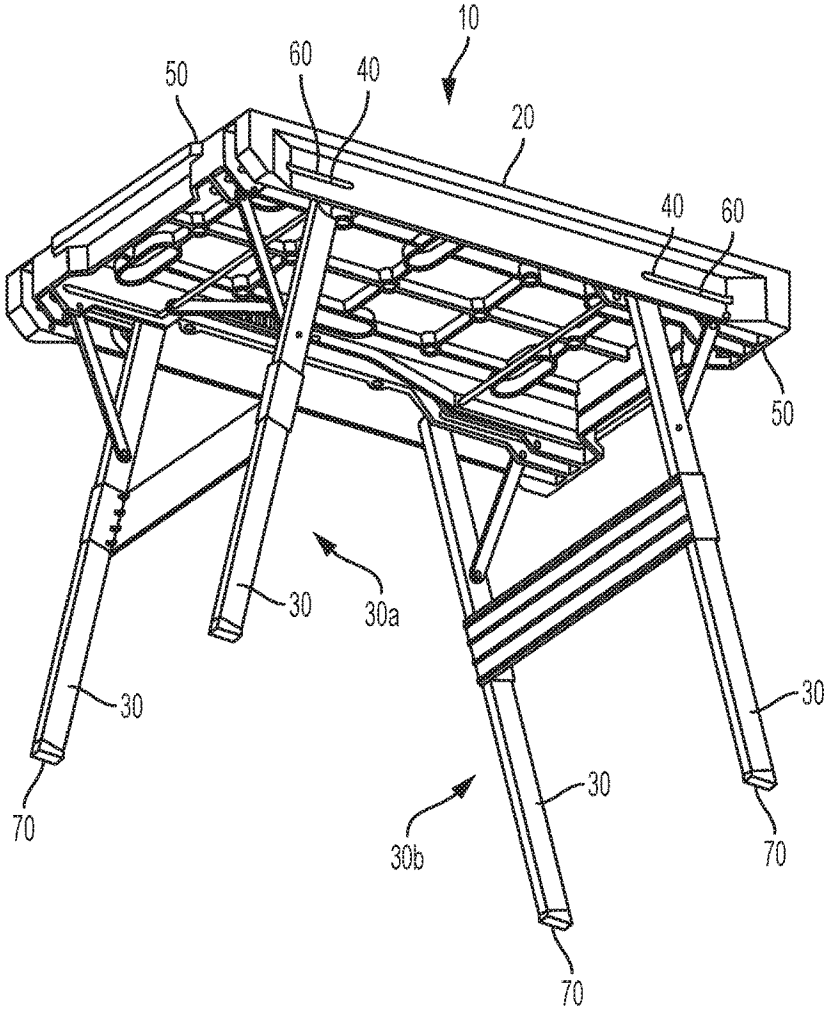

As shown in FIGS. 1A and 1B, an embodiment of a workbench 10 having a sliding leg base. The workbench 10 may fold from an open configuration (FIG. 1A) to a closed configuration (FIG. 1B), so that the workbench 10 may be placed in a compact configuration for storage or transporting. As shown, the work bench 10 may include a table portion 20 with opposing pairs of legs 30*a*, 30*b* (each leg individually and generically 30) pivotally connected thereto. In an embodiment, the legs 30 are configured to lock into the open position of FIG. 1A with the pivot bars 40 of the legs 30 located inward from associated adjacent edges 50 of the table portion 20. As shown, in an embodiment elongated grooves 60 on the table portion may be engaged by the pivot bars 40 of the legs 30, and may facilitate sliding movement of the pivot bars 40 so that the legs 30 may angle outward from an interior region of table portion 20 when in the open position, but the legs 30 may be stored entirely along the full length of the table portion 20 when in the closed position (e.g., with ends 70 of each leg 30 folding close to the opposing one of the edges 50 of the table portion 20.

Figure 2C:
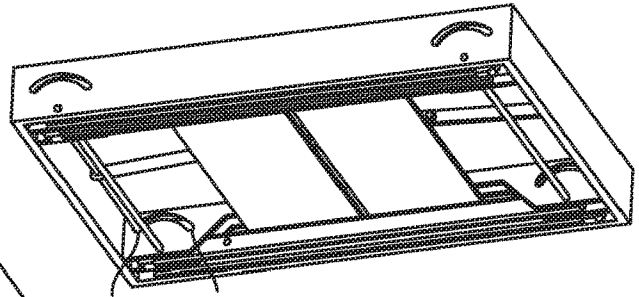
FIGS. 2A through 2D illustrate a second embodiment of a foldable workbench, having a simultaneous leg movement mechanism.
Figure 2B:
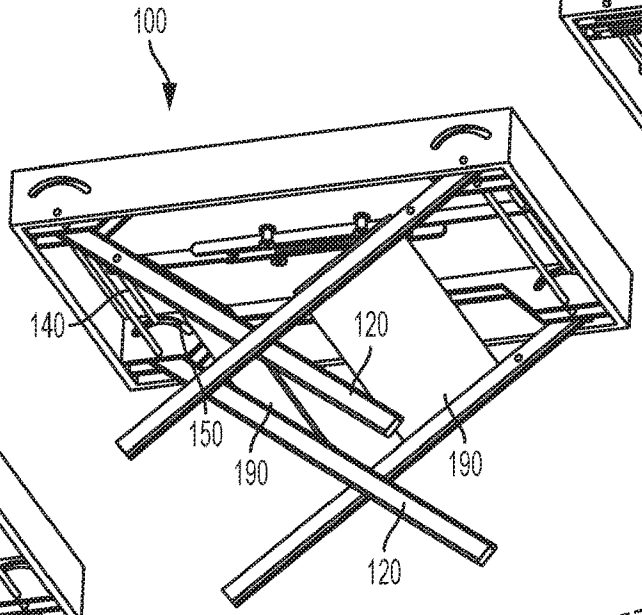
Figure 2D:
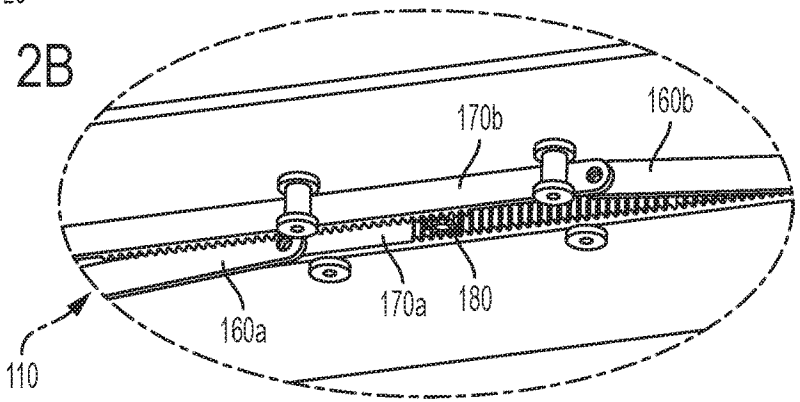
Figure 2A:
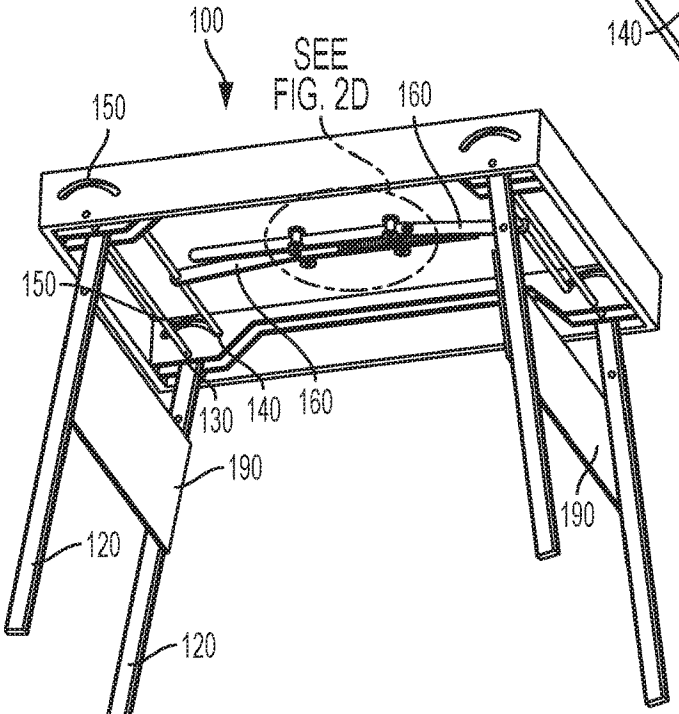

FIGS. 2A-2C illustrate an embodiment of a workbench 100 configured with a double rack and pinion system 110 configured so that the legs 120 for the workbench 100 are opened or closed simultaneously. In an embodiment the system 110 is associated with each leg. As shown in the illustrated embodiment, in some embodiments the system 110 is associated with opposing pairs of legs 120. As shown in FIGS. 2A-2C, closing one pair of the legs 120 configured to pivot at a common pivot bar 130 causes movement of a pivot limit bar 140 (movable in associated arcuate grooves 150) outward from a more center region of the workbench 100 towards an edge of the workbench 100. As further shown, such movement of the pivot limit bar 140 may pull associated an associated arm 160 coupled to the system 110. As in the illustrated embodiment, where one arm 160*a* is coupled through the associated toothed bar 170*a* and gear 180 to another toothed bar 170*b* coupled to another arm 160*b*, pivoting one set of legs 120 would cause simultaneous movement of the opposing set of legs 120. It may be appreciated that such simultaneous movement of the legs 120 may enable opening and closing of the legs without collision of legs 120 with tie-bars 190 in embodiments where one pair of legs 120 fold over the tie-bar 190 associated with the opposing pair of legs 120.

Figure 3:
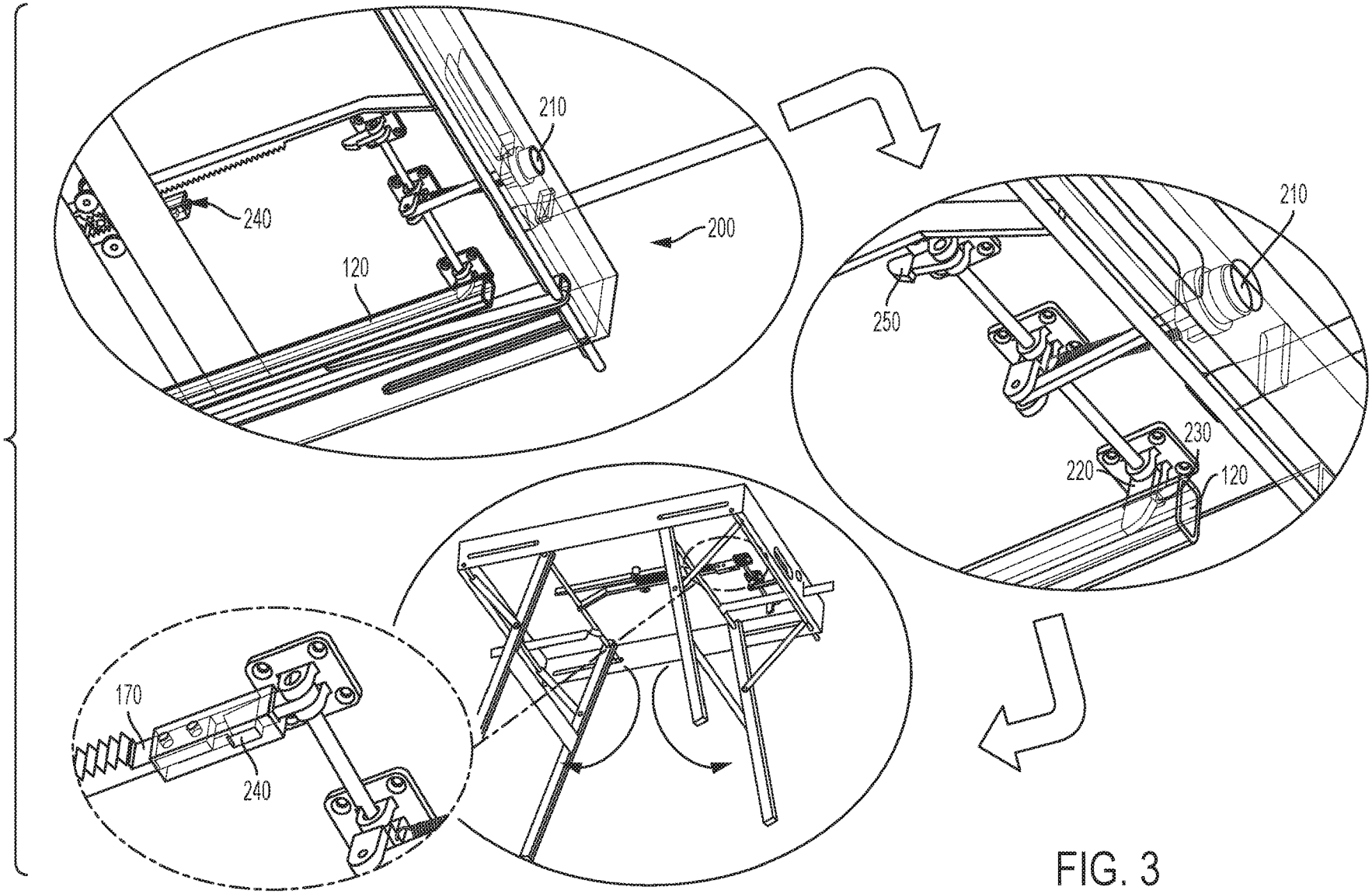
FIG. 3 illustrates a third embodiment of a foldable workbench, having a leg lock mechanism.

FIG. 3 illustrates an embodiment of a workbench 200 which includes the double rack and pinion system 110 of the workbench 100. As shown, the workbench 200 further includes a release button 210 which is coupled to a catch system that may hold the legs 120 alternatively in closed or opened positions. For example, as shown, pressing the button 210 may cause a spring catch 220 to release from an aperture 230 in a leg 120. Accordingly, once released, the legs 120 may unfold as described above with regard to the workbench 100. As further shown, in an embodiment a portion of an embodiment of the system 110 may include a receiving aperture 240 at an end of one toothed bar 170. In an embodiment, the receiving aperture 240 may engage with another spring catch 250 positioned such that the spring catch 250 may engage the receiving aperture 240 when the legs 120 are moved to the opened position. As shown, in an embodiment the release button 210 may actuate release of both the catches 220 and 250. As such, when the workbench 200 is in the opened position, the legs 120 may be locked open until the button 210 is pressed to release the catch 250 from the aperture 240, allowing the legs to fold closed.

Figure 4:
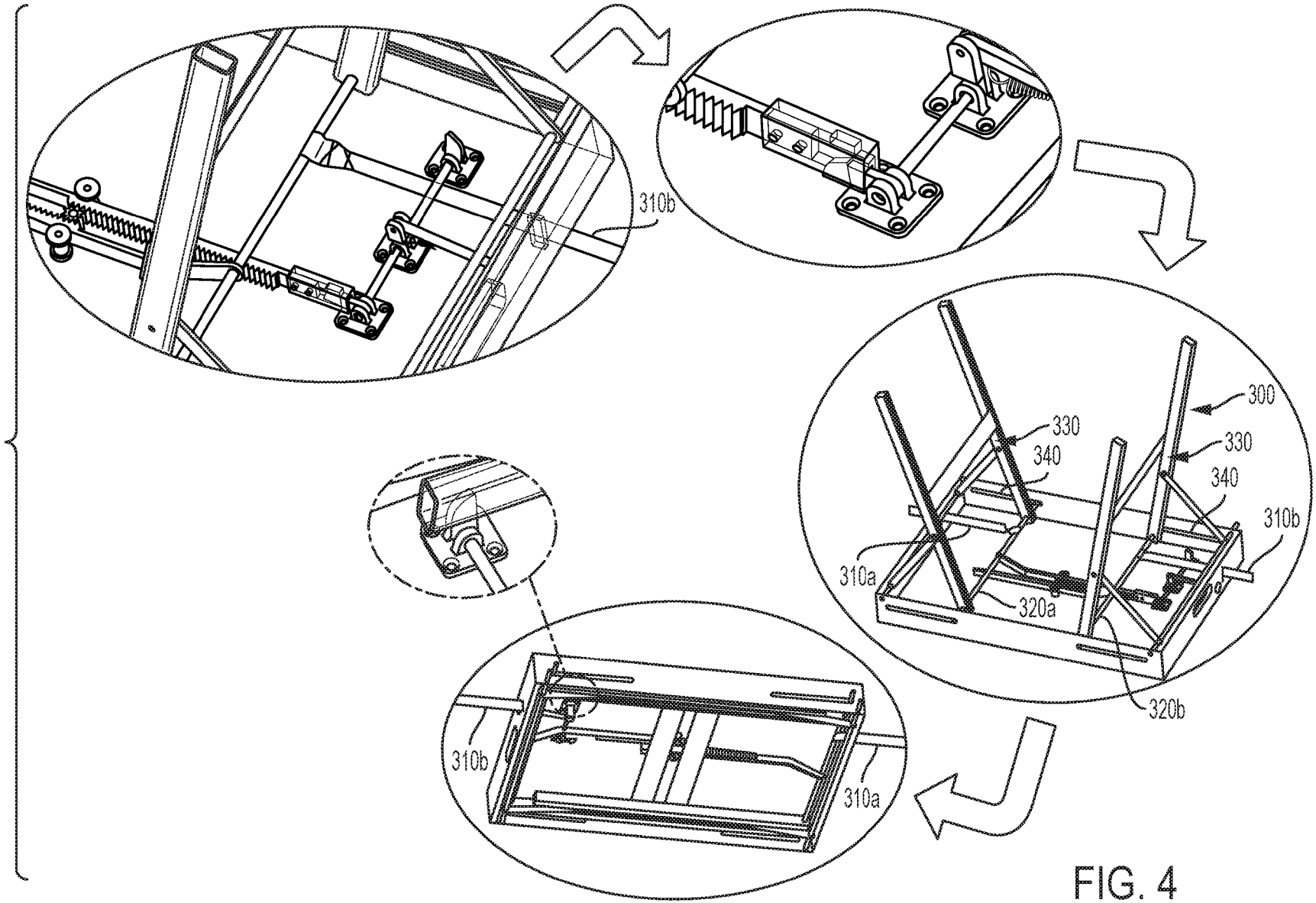
FIG. 4 illustrates a fourth embodiment of a foldable workbench having a pull and carry strap.

FIG. 4 illustrates an embodiment of a workbench 300 that includes a carrying strap 310. It may be appreciated that the carrying strap 310 may be connected as a loop with ends 310*a* and 310*b* coupled to opposing pivot bars 320 associated with opposing pairs of legs 330. As shown, the legs 330 are coupled to the pivot bars 320, which may slide along elongated grooves 340 to form a moving pivot point similar to the grooves 60 described above with respect to the workbench 10. It may be appreciated that as the legs 330 are folded into the closed position, the strap 310 slacks with respect to the workbench 300, creating space for insertion of a hand, arm, or shoulder, for carrying of the workbench 300. It may also be appreciated that where, as here, the workbench 300 includes the release button mechanism of the workbench 200, pulling on the strap 310 while the release button mechanism has disengaged associated latches may pull the legs 330 into the folded position.

Figure 5:
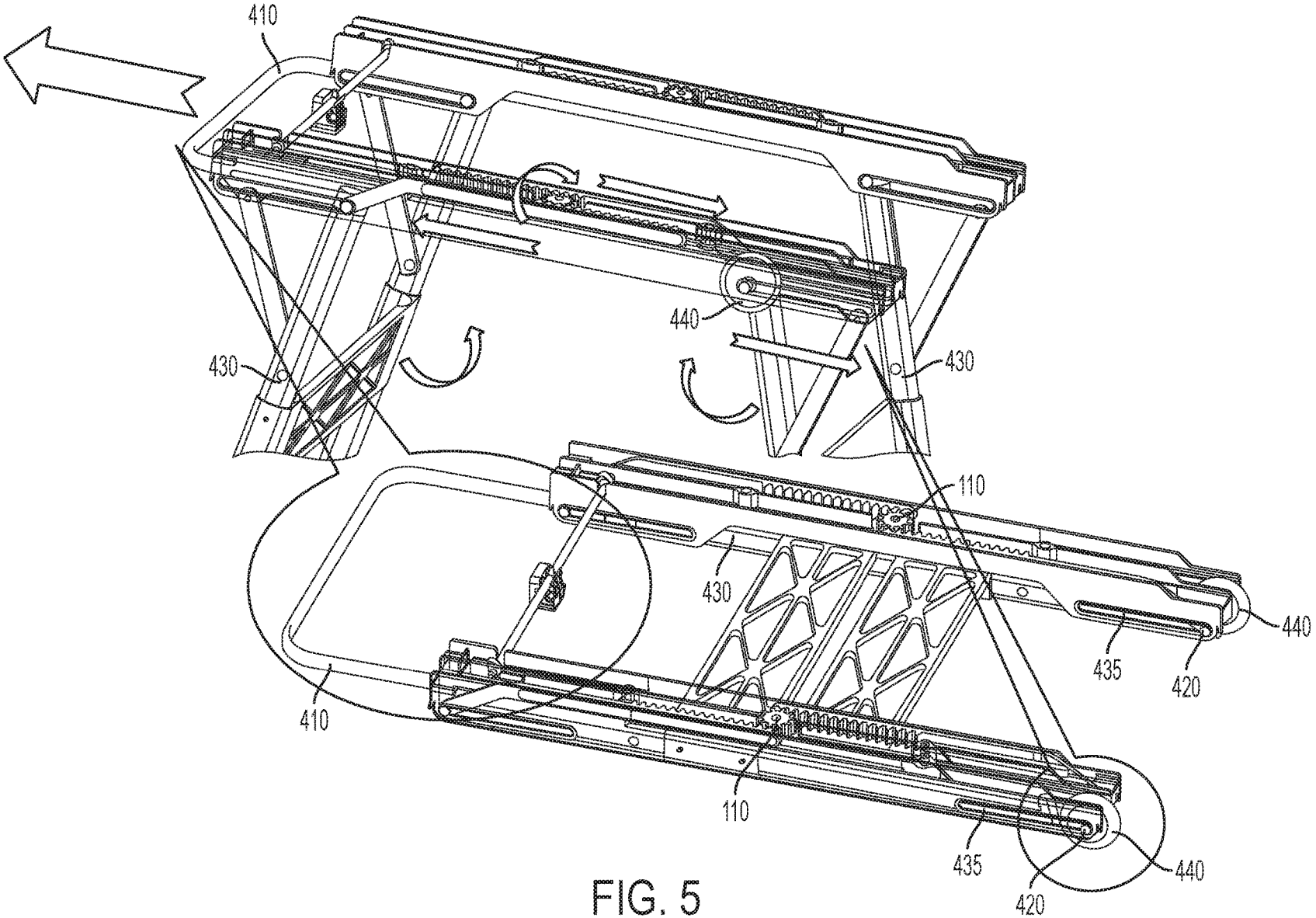
FIG. 5 illustrates another embodiment of a foldable workbench, having a leg movement mechanism with wheels and a pull handle.

FIG. 5 shows a reduced view of a workbench 400 (omitting a work support portion thereof) which includes a handle 410 connected to sliding bars 420 which simultaneously close the legs 430. It may be appreciated that the sliding pivot bars 420 may be similar to the pivot bars 40 as described above with respect to workbench 10, and may slide along associated grooves (e.g., grooves 435 in the illustrated embodiment). As shown, in an embodiment wheels 440 are coupled to the sliding pivot bars 420 distal from the handle 410. As such, pulling the handle 410 both folds the legs 430, as well as causes the wheels 440 to extend from the workbench 400. Accordingly, the handle 410 may be used to pull the workbench 400 as it rolls on the wheels 440. As further shown, in an embodiment multiple double rack and pinion systems 110 may be utilized to facilitate simultaneous movement of the legs 430.

Figure 6A:
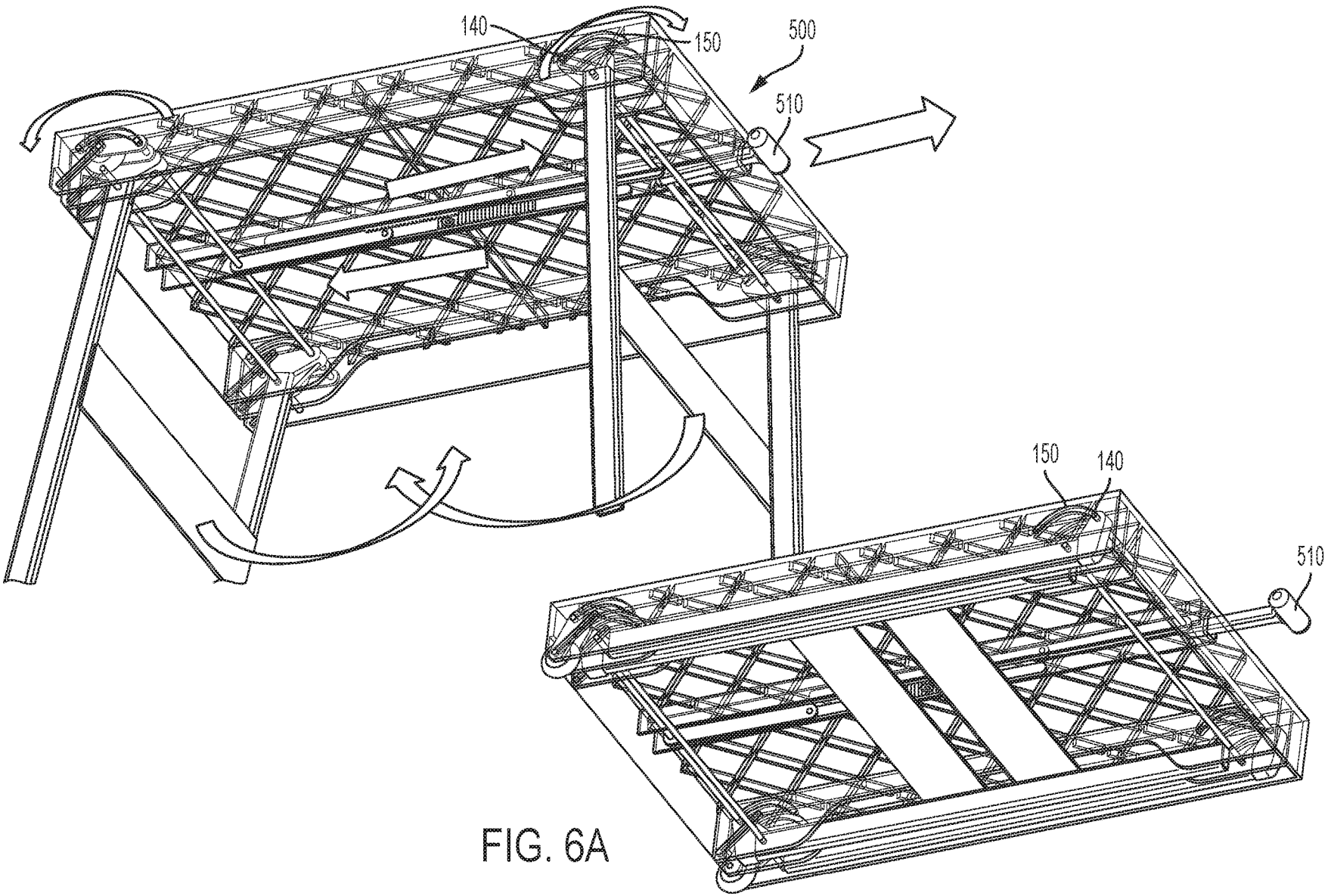
FIGS. 6A and 6B illustrate another embodiment of a foldable workbench having leg movement mechanism with wheels and a pull handle.
Figure 6B:
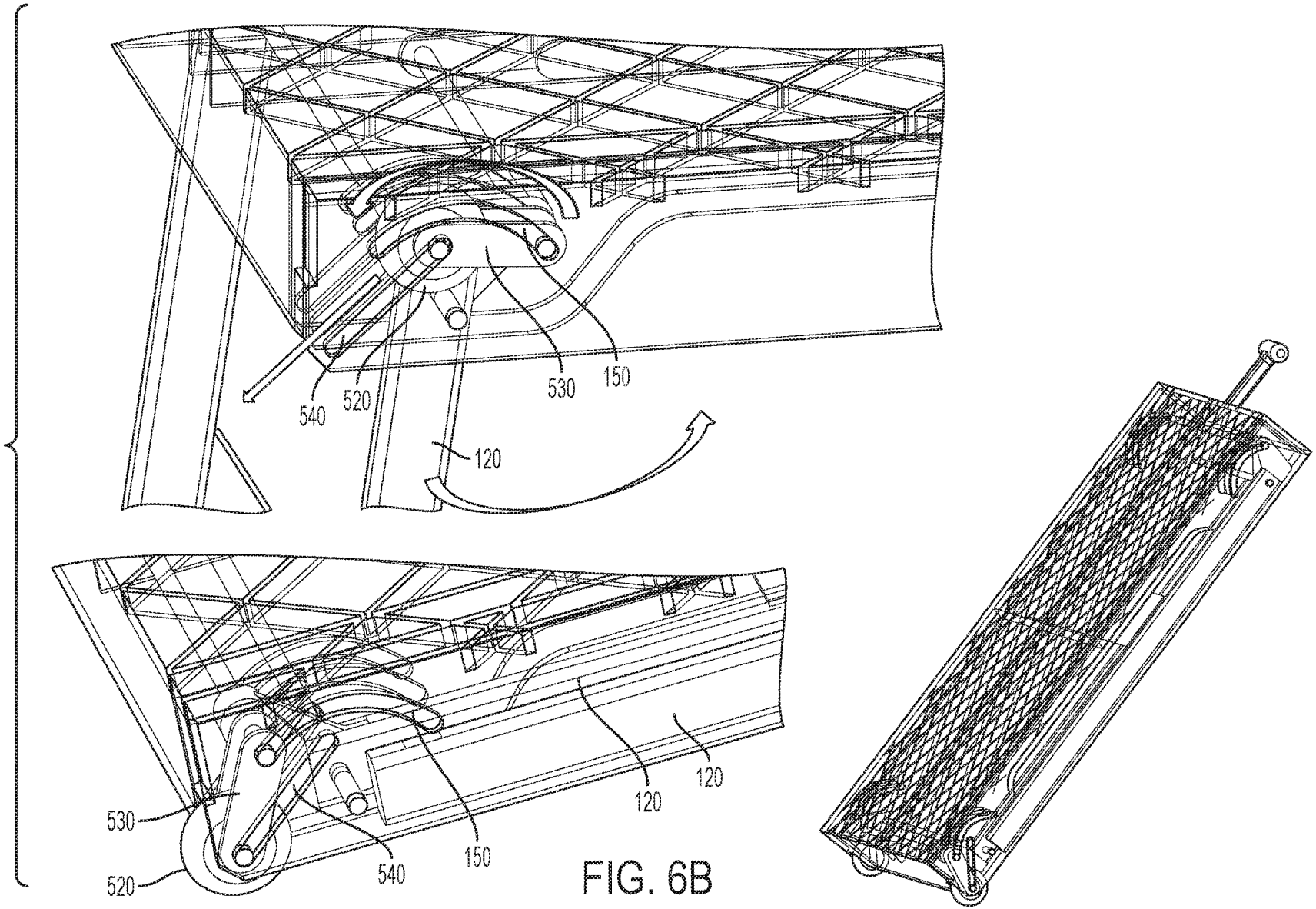

As shown in FIG. 6A, in an embodiment a modification of the workbench 100 (as illustrated as workbench 500) may include a handle 510 which may be coupled to one of the sides of the double rack and pinion system 110. Accordingly, pulling the handle 510 out from the workbench 500 may fold the legs 120 into the workbench 500, while pushing the handle 510 into the workbench 500 may extend the legs 120 therefrom. As further shown in FIG. 6B, in an embodiment the workbench 500 may also include wheels 520 which may be coupled a set of the arcuate grooves 150 of the workbench 500, and may be configured to extend from the workbench 500 when the legs 120 thereof are folded closed. As shown, the wheels 520 may be coupled to sliding hinges 530, which may both move along the arcuate grooves 150 as well as elongated wheel pivot grooves 540. As such, the wheel pivot 550 may be positioned so that portions of the wheel 520 extend out of the workbench 500 when the legs 120 are in the closed position, facilitating rolling of the workbench 500 (such as when pulling the handle 510 in embodiments comprising both the wheels 520 and the handle 510). It may be appreciated that any listed structure or groove in this application may be doubled (e.g., using double walls) so that a pivot bar or point is supported on two sides, as seen in the transparent view of the workbench 500 in FIG. 6B.

Figure 7B:
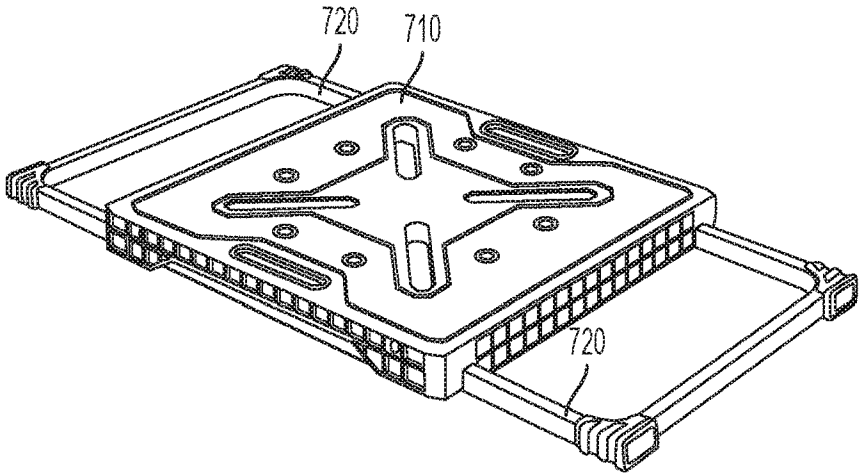
FIGS. 7A-F illustrate other embodiments of a foldable workbench having a clamping surface.
Figure 7A:
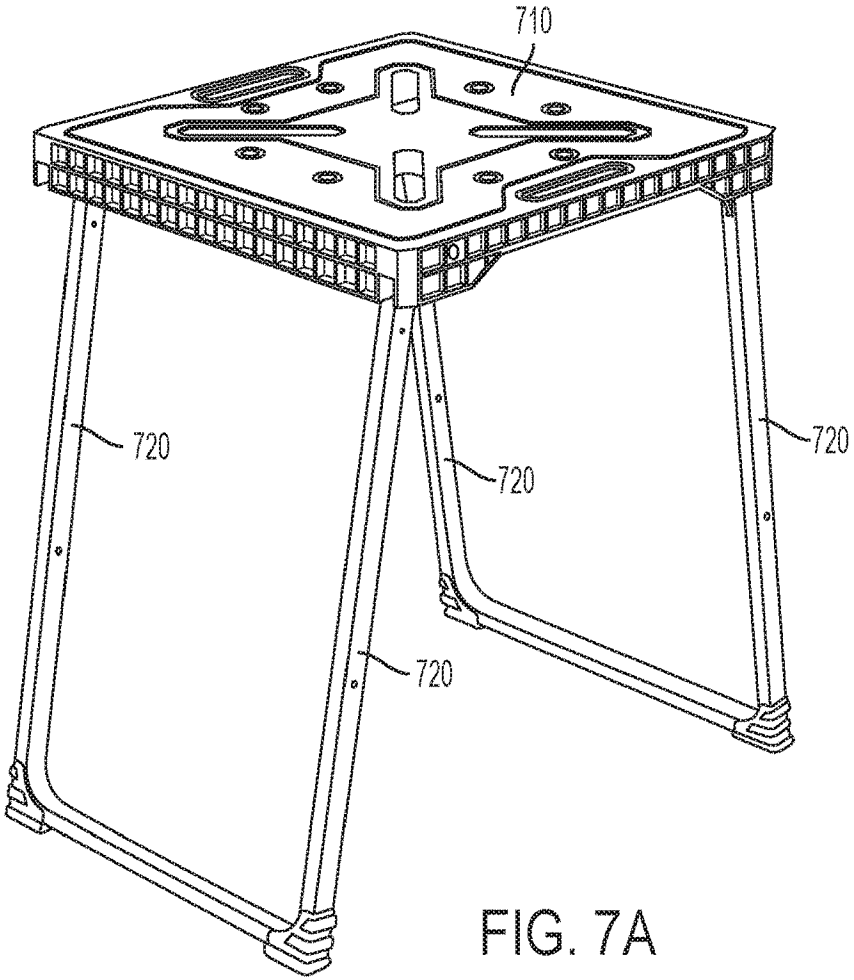

FIG. 7A illustrates an embodiment of a workbench 700 configured for a variety of clamping arrangements when used with supplemental clamps, as described in greater detail below. As shown, the workbench 700 includes a work support structure 710 and legs 720. In some embodiments, such as that shown, pairs of the legs 720 may be coupled together (e.g., where each pair of legs forms a U-shape). As shown in FIG. 7B, the workbench 700 may be folded into a flat configuration, as described below.

Figure 7D:
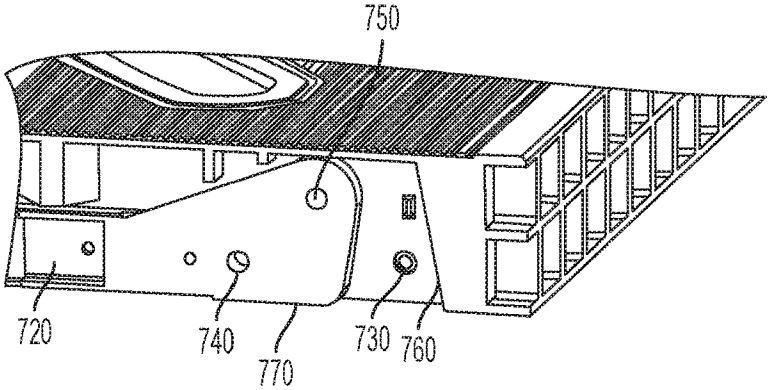

Specifically, in an embodiment the workbench 700 may include a lock pin 730 which may engage with a lock hole 740 associated with at least one of the legs 720. Accordingly, retracting the lock pin 730 may free the leg 720 to pivot at a pivot structure 750, as shown in FIGS. 7C and 7D. In an embodiment, a surface 760 of the work support structure 710 may be angled so that an associated portion 770 of the leg 720 may engage therewith when the leg 720 is extended from the work support structure 710. It may be appreciated that the legs may angle outwards to create such engagement, further preventing the legs from folding inwards when a weight is applied to the workbench 700.

Figure 7F:
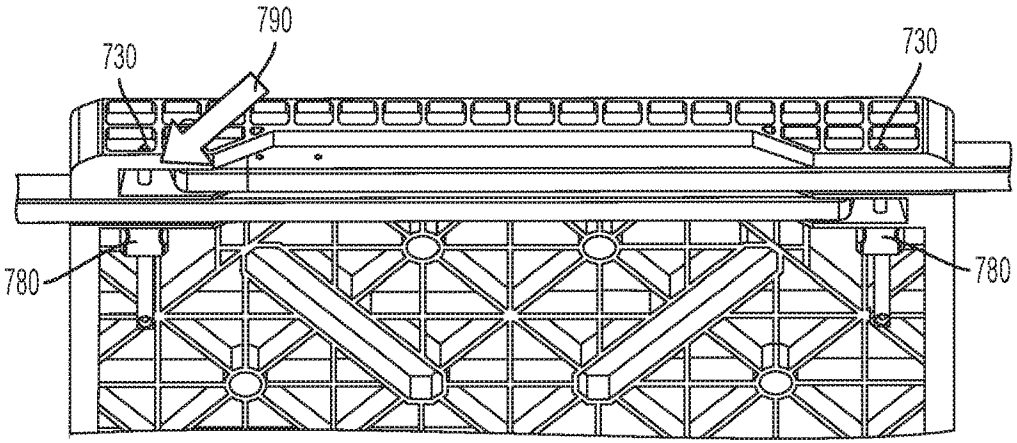
Figure 7C:
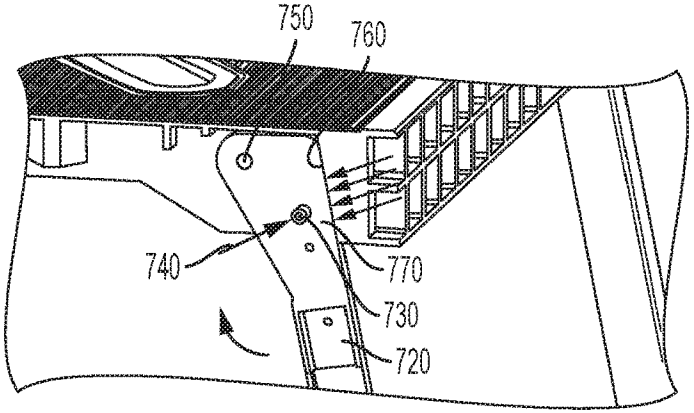
Figure 7E:
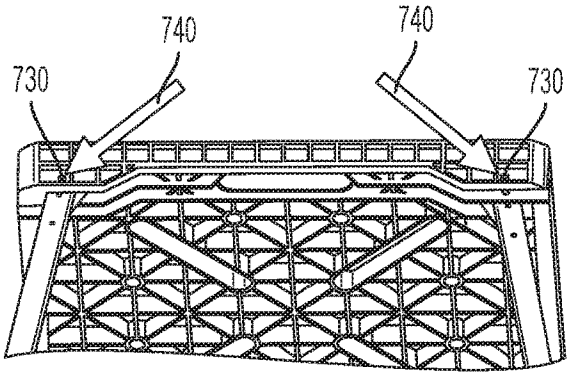

As further shown in FIGS. 7E and 7F, in some embodiments the lock pin 730 may be spring biased into an extended position, activated by a spring biased actuator 780 which may retract the lock pins 730 out of the lock holes 740 to permit pivoting of the legs 720. In an embodiment, the legs 720 may have additional lock holes 790 distal from their lock holes 740. As such, the lock holes 790 may be positioned so as to receive the lock pins 730 when the legs 720 are in their folded closed position.

Figure 8C:
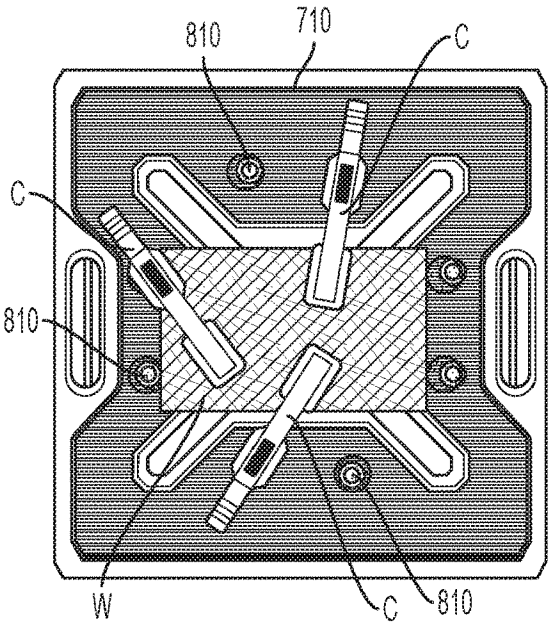
FIGS. 8A-E illustrate a variety of clamping configurations for the workbenches of FIGS. 7A-F.
Figure 8B:
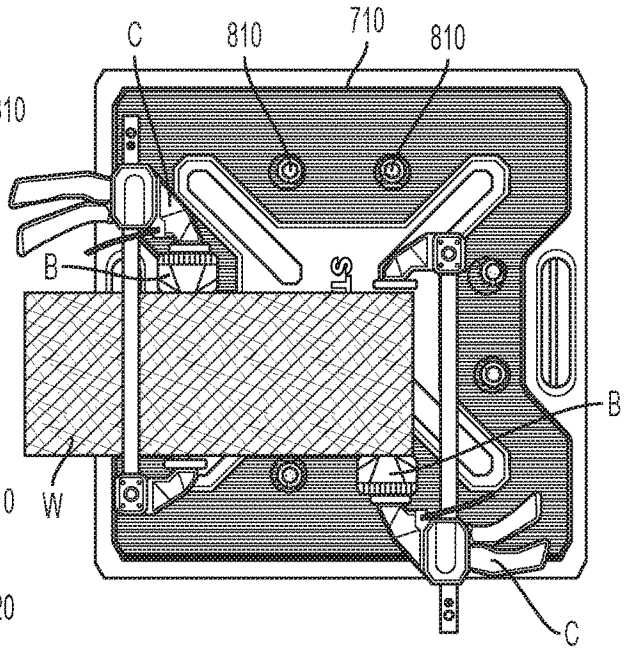
Figure 8A:
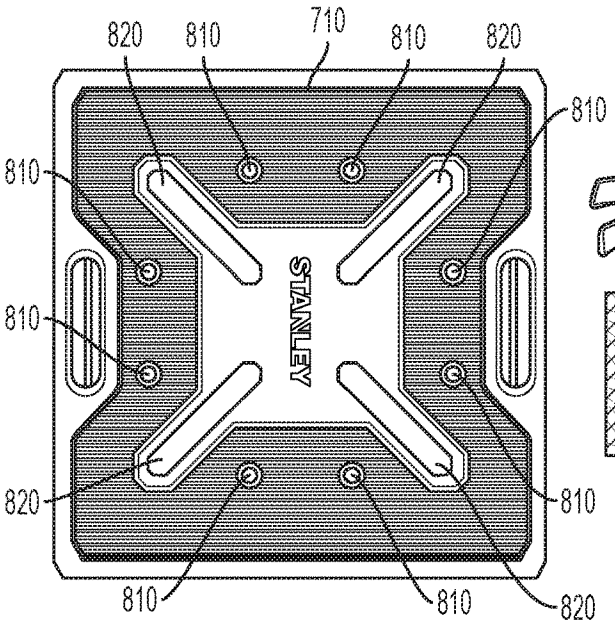
Figure 8E:
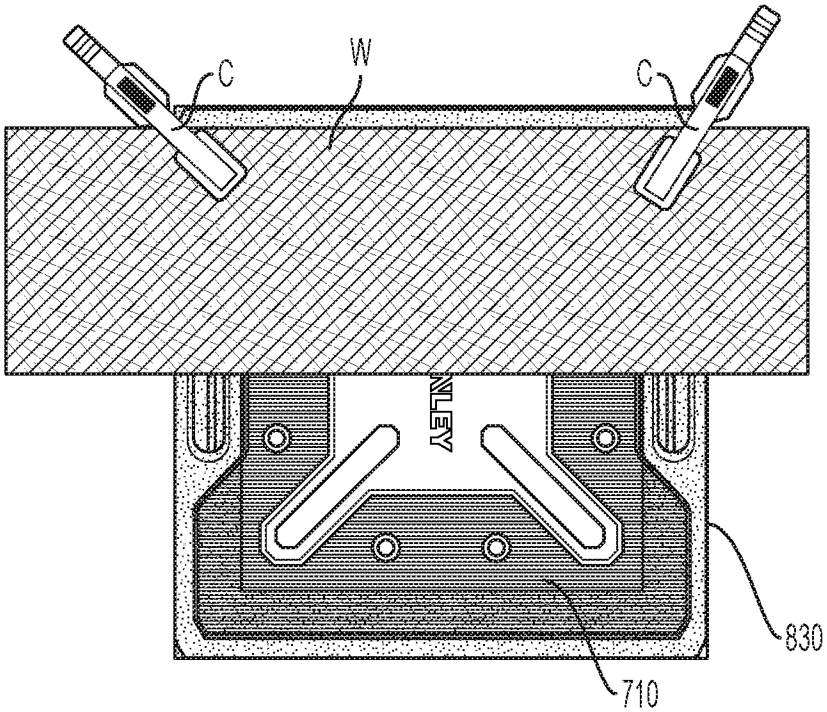

FIGS. 8A-E illustrate an embodiment of the work support structure 710, with FIGS. 8B-E showing various clamping options enabled by its configuration. As shown in FIG. 8A, the work support structure 710 may include holes 810 and slots 820. As shown in the illustrated embodiment, in some embodiment the slots 820 may be elongated from a center region towards corner regions of the support structure 710. In an embodiment, the holes 810 may surround the slots 820. Other positioning of the slots 820 and holes 810 may be possible in other embodiments. As shown in FIG. 8B, in an embodiment the support structure 710 may be configured to support bench dogs B (e.g., by being partially received in the holes 810 thereof), so as to facilitate clamping of a workpiece W in a horizontal position by clamps C.

Figure 8D:
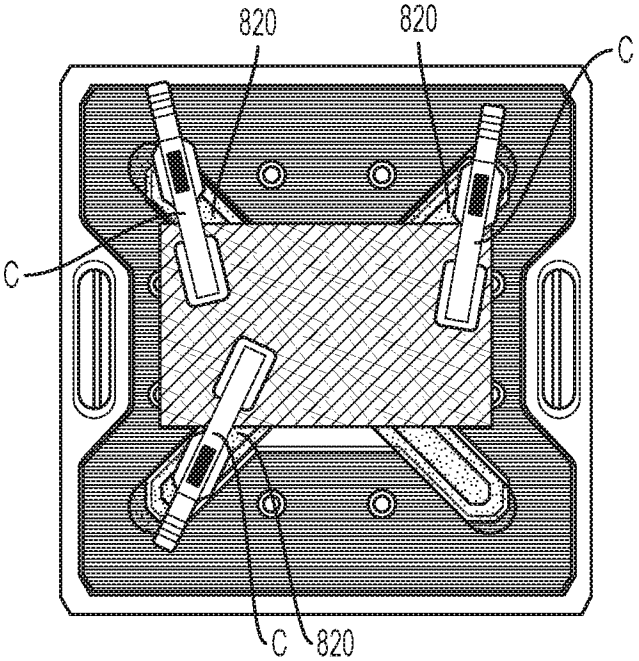
Figure 9B:
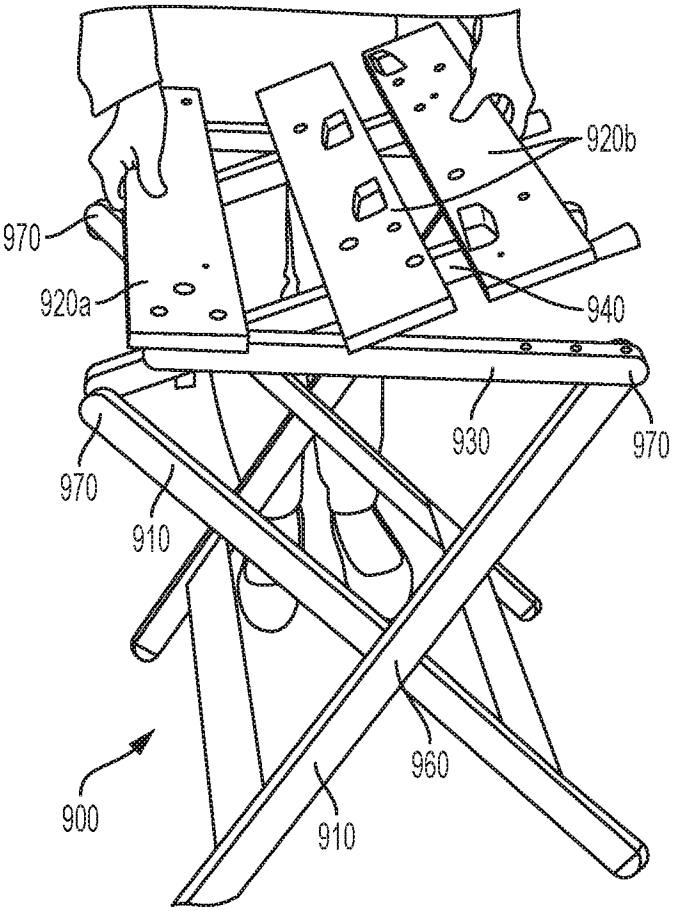
FIGS. 9A-D illustrate another embodiment of a foldable workbench having a height adjustable work support surface.
Figure 9A:
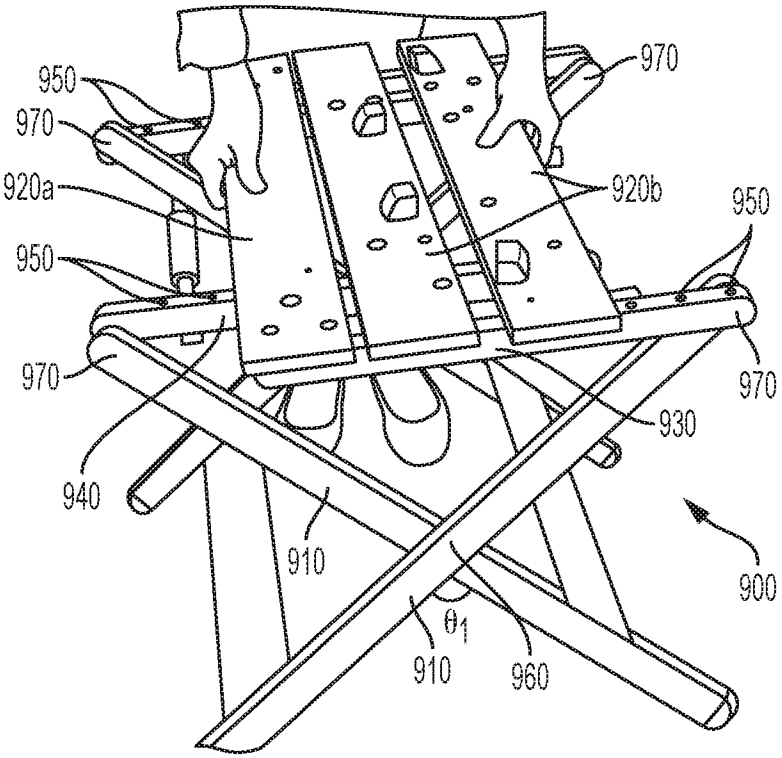
Figure 9D:
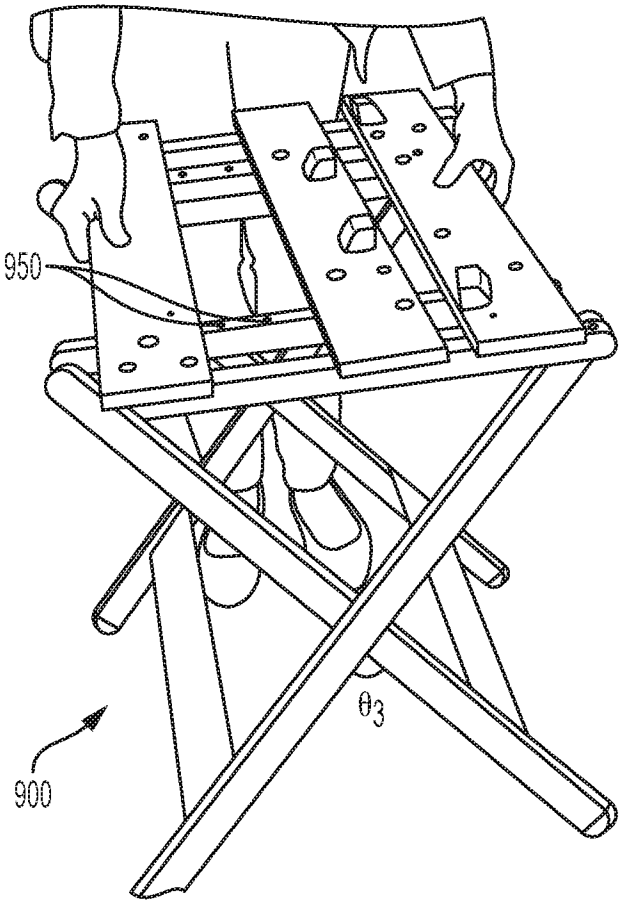
Figure 9C:
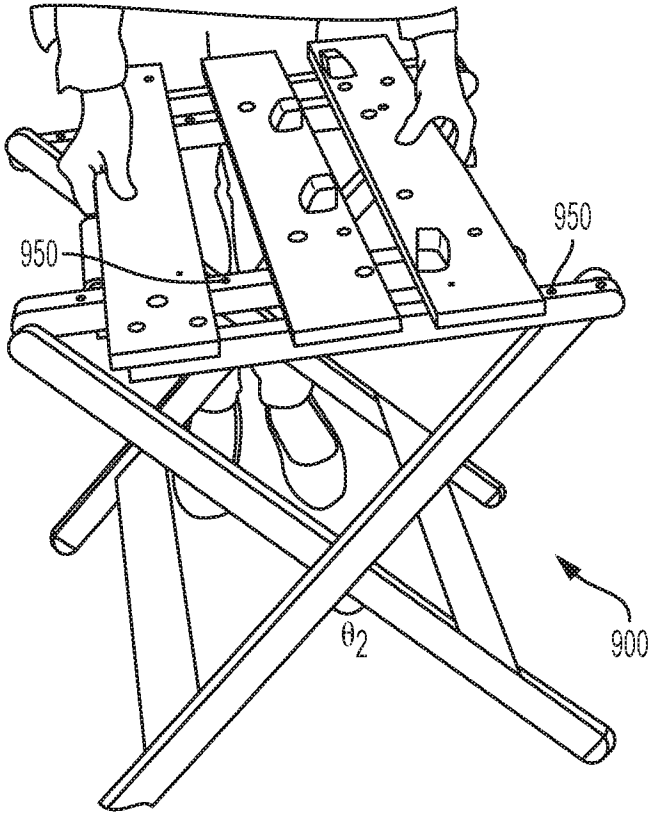

As shown in FIGS. 8C and 8D, in an embodiment the bars of the clamps C may extend through either the holes 810 or the slots 820 so as to clamp the workpiece W to the support structure 710 in a variety of positions. As further shown in FIG. 8E, in an embodiment an outer peripheral region 830 of the support structure 710 may be reinforced (e.g. with honeycombed plastic, metal reinforcements, or other structures) so as to facilitate clamping the workpiece W against the support structure 710 at the outer periphery of the support structure 710.

FIGS. 9A-E show another embodiment of a workbench of the present disclosure. As shown, the workbench 900 includes pairs of crossed legs 910 that facilitate raising and lowering of a work surface 920 pivotally coupled to the pairs of crossed legs 910. As shown, the work surface 920 includes a first portion 920*a* that is coupled to a first support frame 930. The work surface also includes a second portion 920*b* that is coupled to a second support frame 940. It may be appreciated that in some embodiments portions of the second portion 920*b* may be slidable across the second portion 920*b* relative to each other, to facilitate clamping of work pieces there between.

As shown, in an embodiment the second support frame 940 may include receiving holes 950 which may be associated with different locking positions to lock engaging protrusions of the first portion 920*a* therein. As shown in the illustrated embodiment, portions of the first support frame 930 may additionally have receiving holes 950 in some embodiments, which may be engaged by engaging protrusions of the second portion 920*b*. It may further be appreciated that pivots 960 at the intersection of the crossed legs 910, and pivots 970 between the legs 910 and the first support frame 930 or between the legs 910 and the second support frame 940 may facilitate relative movement of the first portion 920*a* and the second portion 920*b*, as well as associated movement of the legs 910 closer to each other or further from each other. By varying the separation of the first portion 920*a* and the second portion 920*b*, and locking the portions 920 in different sets of receiving holes 930, the workbench 900 may be locked with the legs 910 at different angles to each other, and thus raising and lowering the work surface 920 relative to the ground, such as is shown in the low position of FIG. 9A, the intermediate position of FIG. 9C, and the high position of FIG. 9D, where $\theta_1>\theta_2>\theta_3$.

In some embodiments, pulling the first portion 920*a* and second portion 920*b* away from one another such that the legs 910 pull close to one another may place the workbench 900 in a position for flat folding. Specifically, the left side and right side pivots 970 may be pulled close to each other, allowing both the first portion 920*a* and the second portion 920*b* to fold downward against the legs 910.

Figure 10A:
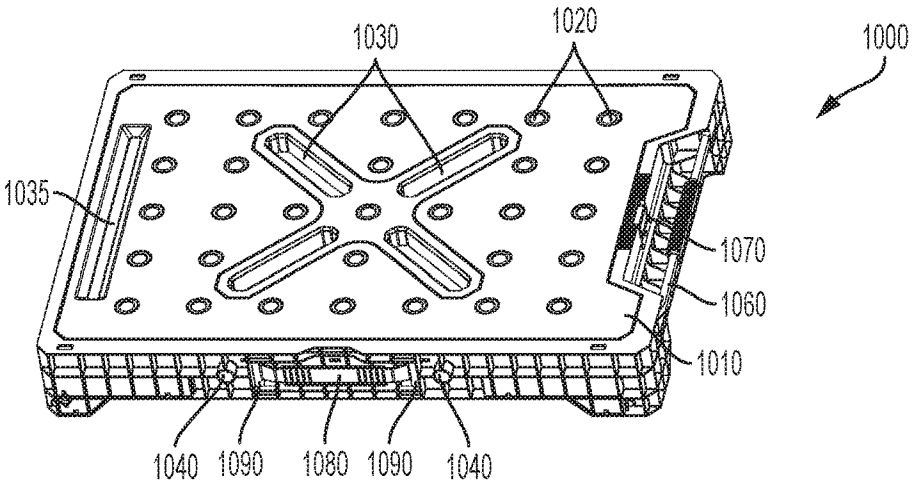
FIGS. 10A-B illustrate another embodiment of a foldable workbench including features from prior embodiments disclosed herein, with FIG. 10A illustrating a top perspective view, and FIG. 10B illustrating a bottom perspective view with legs thereof in a folded configuration.
Figure 10B:
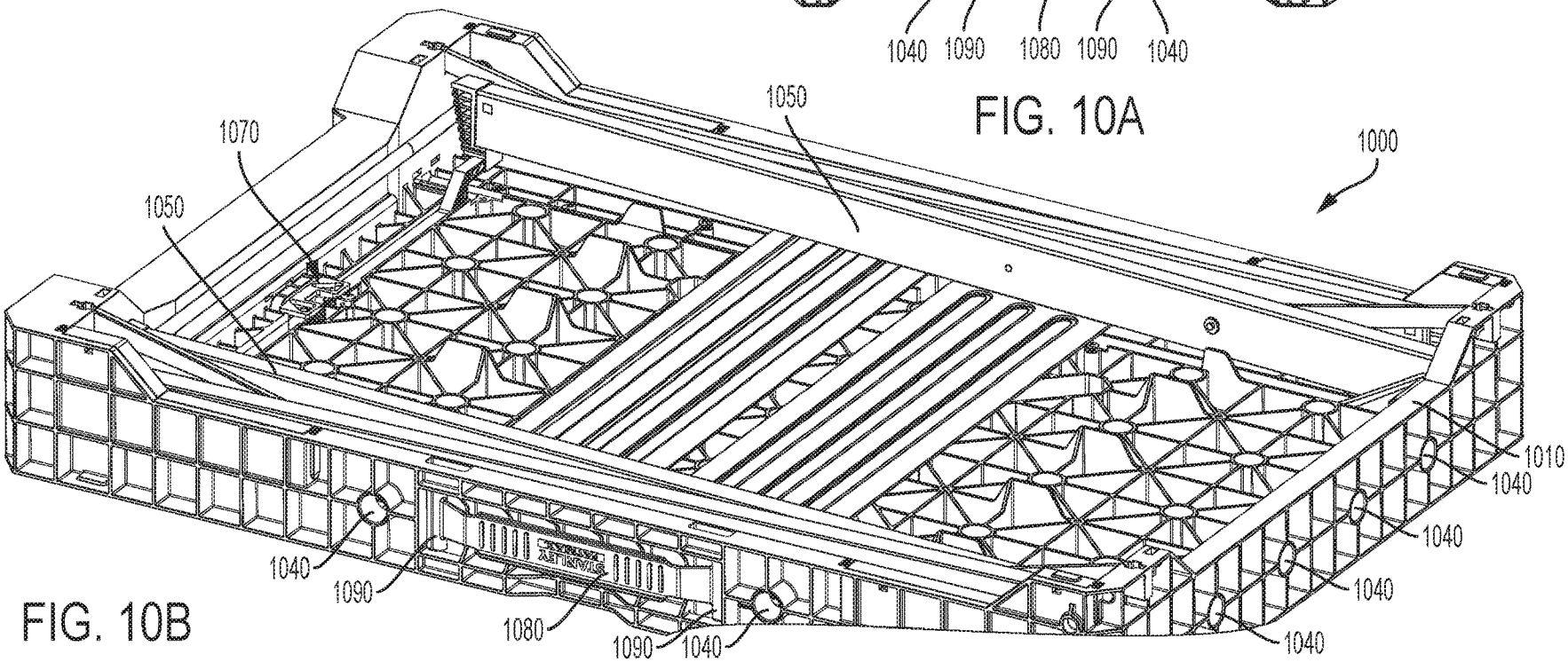

It may be appreciated that in some embodiments, features of some embodiments described herein may be combined into other embodiments described herein. Accordingly, FIGS. 10A-10B illustrate an embodiment of a workbench 1000 having various features described above. For example, the workbench 1000 includes a work support structure 1010 including one or more of holes 1020 and slots 1030 which may in some embodiments be similarly configured to the holes 810 and slots 820 described above with reference to FIGS. 8A-E. For example, the holes 1020 and slots 1030 may be positioned on the work support structure 1010 so as to facilitate placement of accessories, blocks, or clamps therein that facilitate clamping or other work to the work support structure 1010. In some embodiments, the work support structure 1010 may include grooves such as groove 1035, which may form a gutter or channel to contain small items such as pencils, screws, nails, bits, or so on, and may prevent them from rolling off of the work support structure 1010, or falling through the holes 1020 and/or slots 1030 thereof.

As shown in FIG. 10A, in an embodiment side holes or slots 1040 may be formed in sides of the work support structure 1010. In an embodiment, side holes or slots 1040 on opposing sides of the work support structure 1010 may be aligned so that clamps or other accessories may be installed extending from one side of the work support structure 1010 to an opposing side of the work support structure 1010, which may facilitate supporting a work piece on an upper surface of the work support structure 1010 from opposing sides thereof that extend beyond the upper surface of the work support structure 1010.

As described in greater detail below, the workbench 1000 includes legs 1050 which may selectively unfold from the underside of the work support structure 1010. It may be appreciated that such unfolding or folding may be actuated by a pull handle 1060 which in an embodiment may be similar to the handle 410 described above with reference to FIG. 5. As also described below, in an embodiment a leg latch mechanism 1070 may be provided which may selectively lock the legs 1050 and movement of the handle 1060 as described below.

Further shown in FIGS. 10A and 10B is a carry handle 1080 which in an embodiment may be retractable into a recess in the work support structure 1010. In an embodiment the carry handle 1080 may be biased into a retracted position, while in other embodiments the carry handle 1080 may simply be depressed back into the recess in the work support structure 1010 when not being utilized. As shown, in an embodiment engagement pins 1090 for the carry handle 1080 may slide in associated slots in the work support structure 1010, thus facilitating selectively creating a gap between the carry handle 1080 and the work support structure 1010. In other embodiments the carry handle 1080 may be formed of a resilient material, or may otherwise give to expand away from the work support structure 1010.

Figure 11:
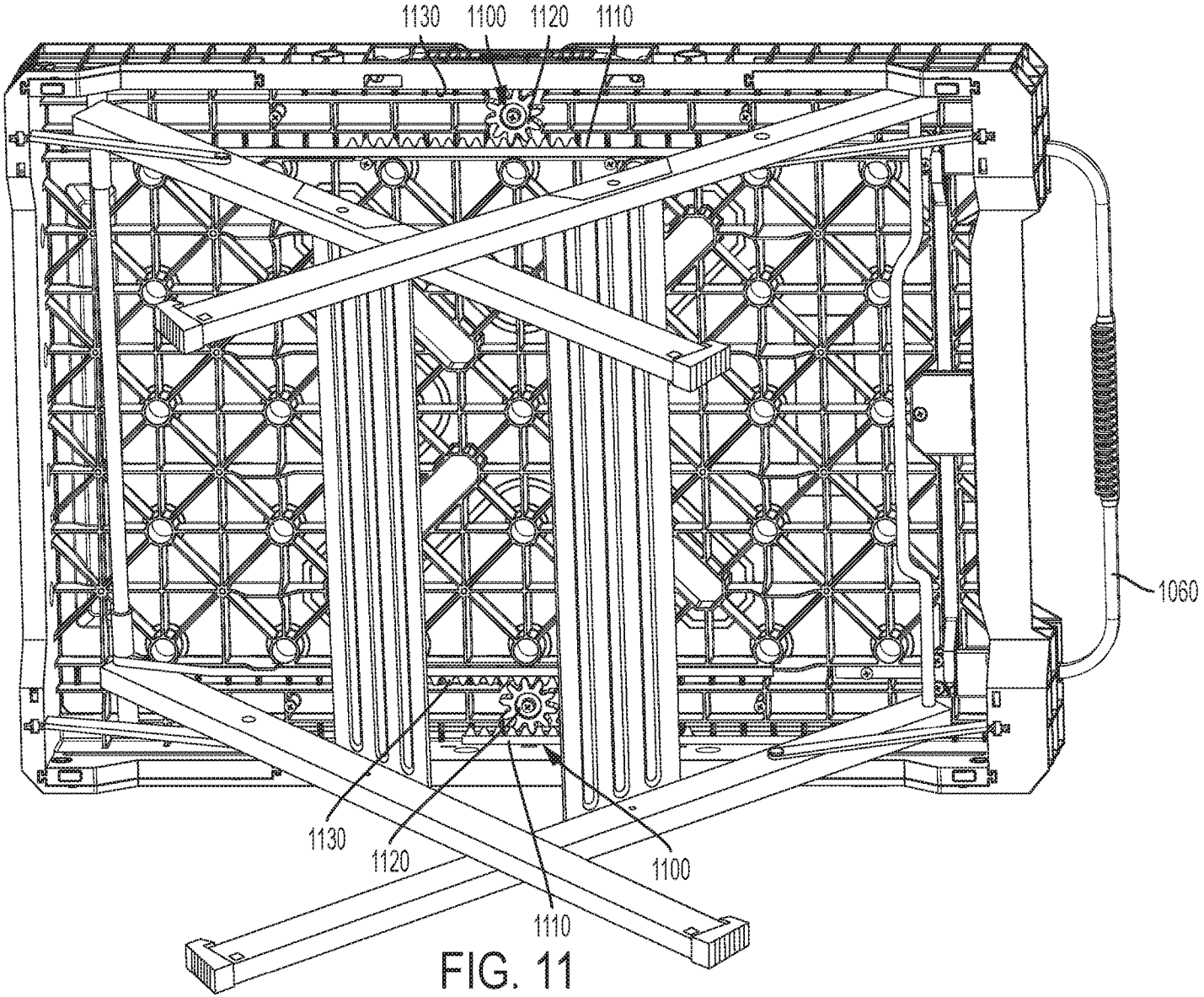
FIG. 11 illustrates a bottom perspective view of the foldable workbench of FIGS. 10A-B with the legs thereof in a partially unfolded configuration.

FIG. 11 illustrates the legs 1050 of the workbench 1000 in a partially extended position. As shown, in an embodiment the legs 1050 may open simultaneously via a rack and pinion system 1100 which may be similar to the rack and pinion system 110 described above. Accordingly, as the handle 1060 is pulled away from the work support structure 1010, the rack bars 1110 of the rack and pinion system 1100 which are fixed relative to the handle 1060 may be pulled by the handle 1060, which in turn may drive the pinion gears 1120 to push the opposing rack bars 1130. It may be appreciated that other movement of the handle 1060 (e.g., pushing the handle 1060 further into the work support structure 1010) may similarly cause movement in the rack and pinion system 1100 in some embodiments. Accordingly, with the pairs of opposing legs 1050 also coupled to pairs of the rack bars 1110 and rack bars 1130, the pairs of opposing legs 1050 may simultaneously pivot outward from the work support structure 1010 in the manner described above through movement of the handle 1060, with sets of the rack bars 1110 and the rack bars 1130 pulling wider sets or a narrower set of the legs 1050, such that the narrower set of the legs 1050 may nest within the wider set of the legs 1050 when the legs 1050 are in a folded configuration.

Figure 12:
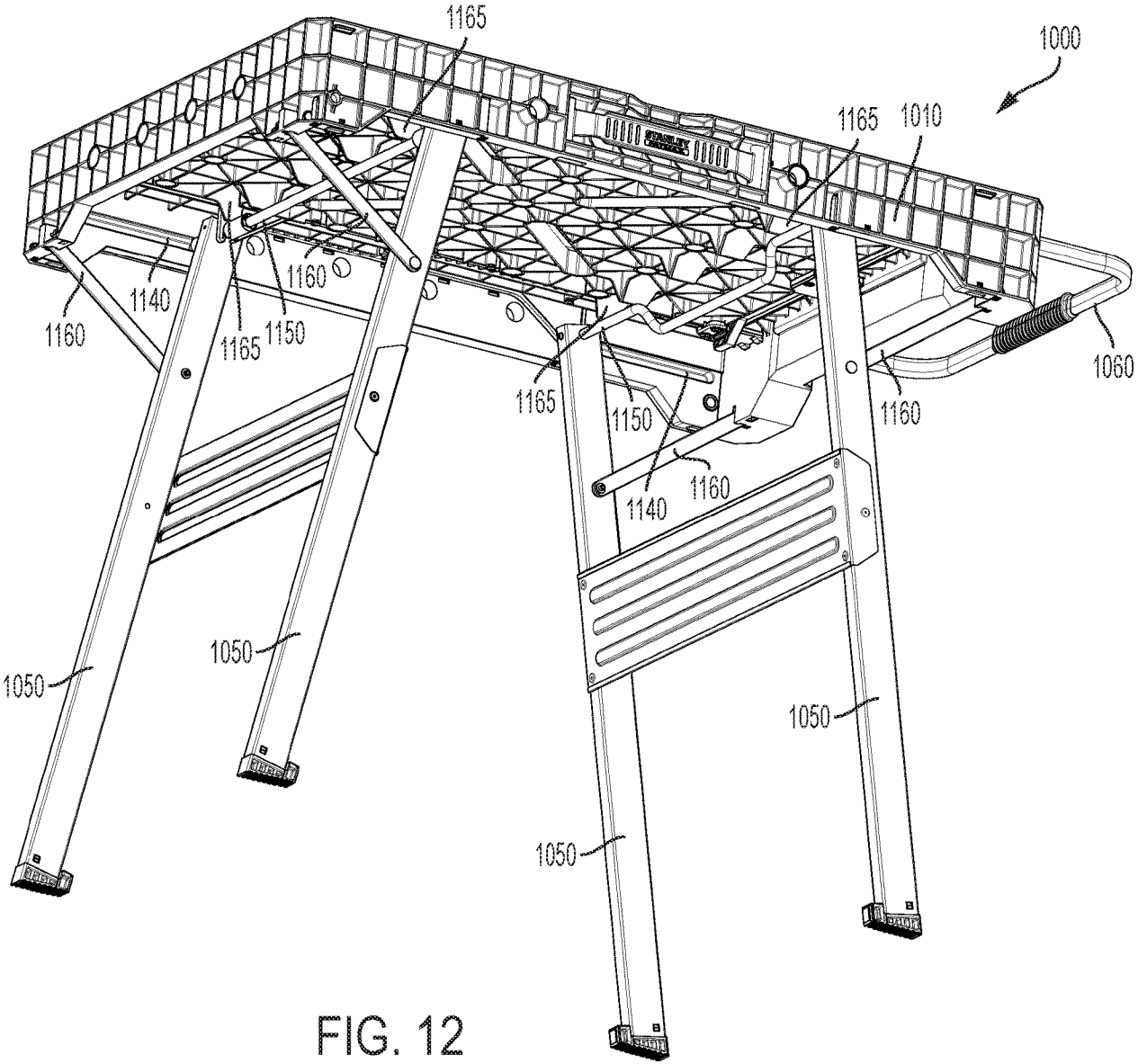
FIG. 12 illustrates a bottom perspective view of the foldable workbench of FIGS. 10A-B with the legs thereof in a fully unfolded configuration.

It may be appreciated from the bottom perspective view of the workbench 1000 in FIG. 12, that the legs 1050 may couple to the work support structure 1010 at grooves 1140, which may be similar to the grooves 435 and grooves 40 in the embodiments described above in some embodiments, and may facilitate the legs 1050 unfolding at an outward angle from an interior region of the work support structure 1010. Specifically, it may be appreciated that axles 1150 coupling associated pairs of legs 1050 may extend into the grooves 1140. As the legs 1050 extend by the axles 1150 are drawn towards the center of the work support structure 1010, the legs 1050 may lean on support bars 1160 pivotally coupled between the work support structure 1010 and the legs 1050. In some embodiments receiving members within the grooves 1140 may provide additional support to the engagement between the axles 1150 and the grooves 1140. It may be appreciated that grooves 1140 may comprise slots, apertures, rails, or other equivalent structures facilitating the sliding of the axles 1150 relative to the work support structure 1010. As further shown in FIG. 12, a load on the work support structure 1010 may be distributed into the legs 1050 by a number of structures to spread the load. For example, the region of the work support structure 1010 at the grooves 1140 may be formed of a thicker material than elsewhere on the work support structure 1010 (e.g., at the points where the legs 1050 engage the grooves 1140 and the work support structure 1010. As another example, the support bars 1160 may be received in the work support structure 1010 at reinforced or thicker regions thereof. As a further example, a plurality of ribs 1165 on the underside of the work support structure 1010 where the axles 1150 are positioned when the legs 1050 are in a fully extended position may contact the axles 1150 and further distribute a load from the work support structure 1010 onto the axles 1150 and thus onto the legs 1050.

Figure 13:
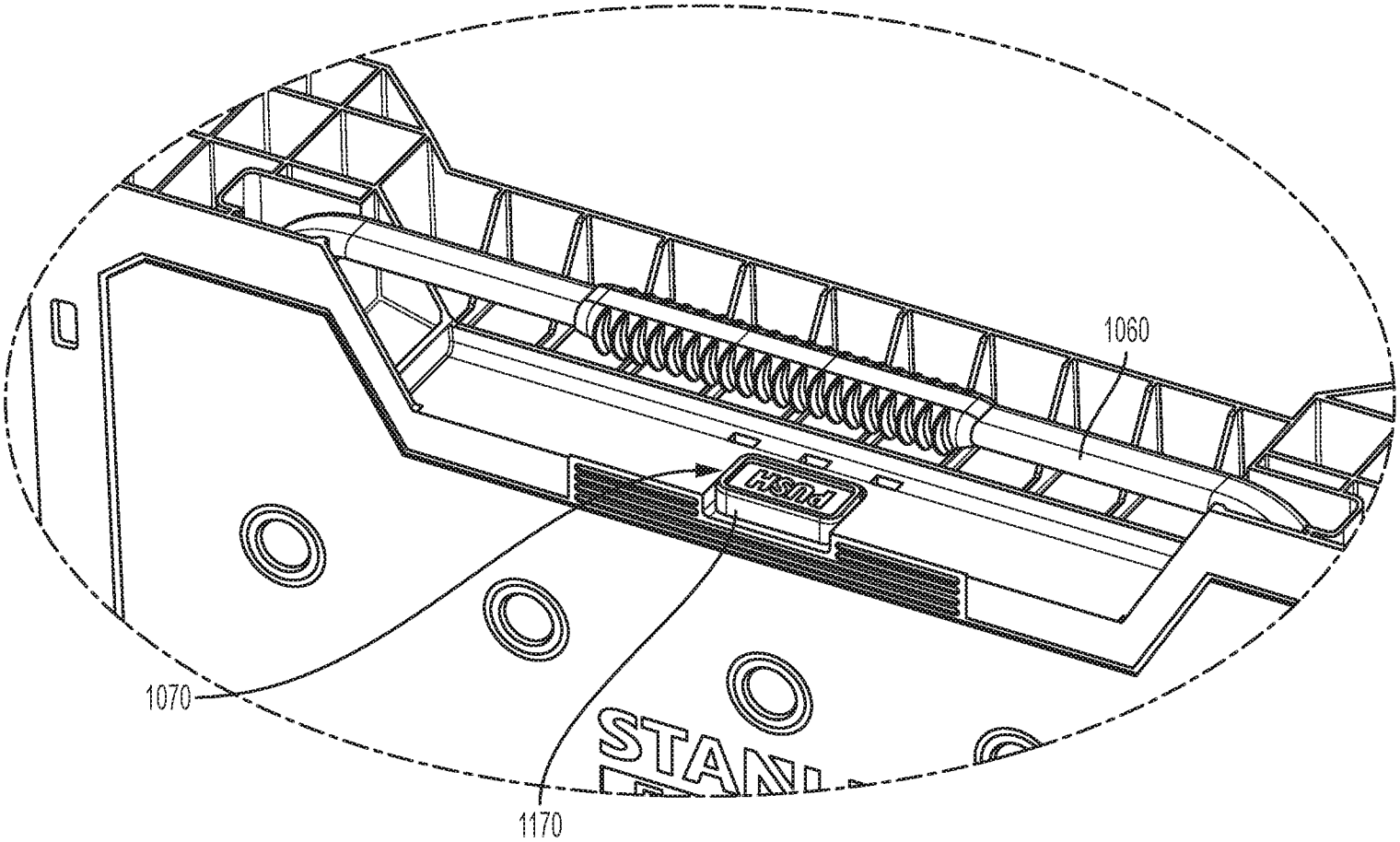
FIG. 13 illustrates an isolated top perspective view of a handle and leg lock button of the foldable workbench of FIGS. 10A-B.
Figure 14:
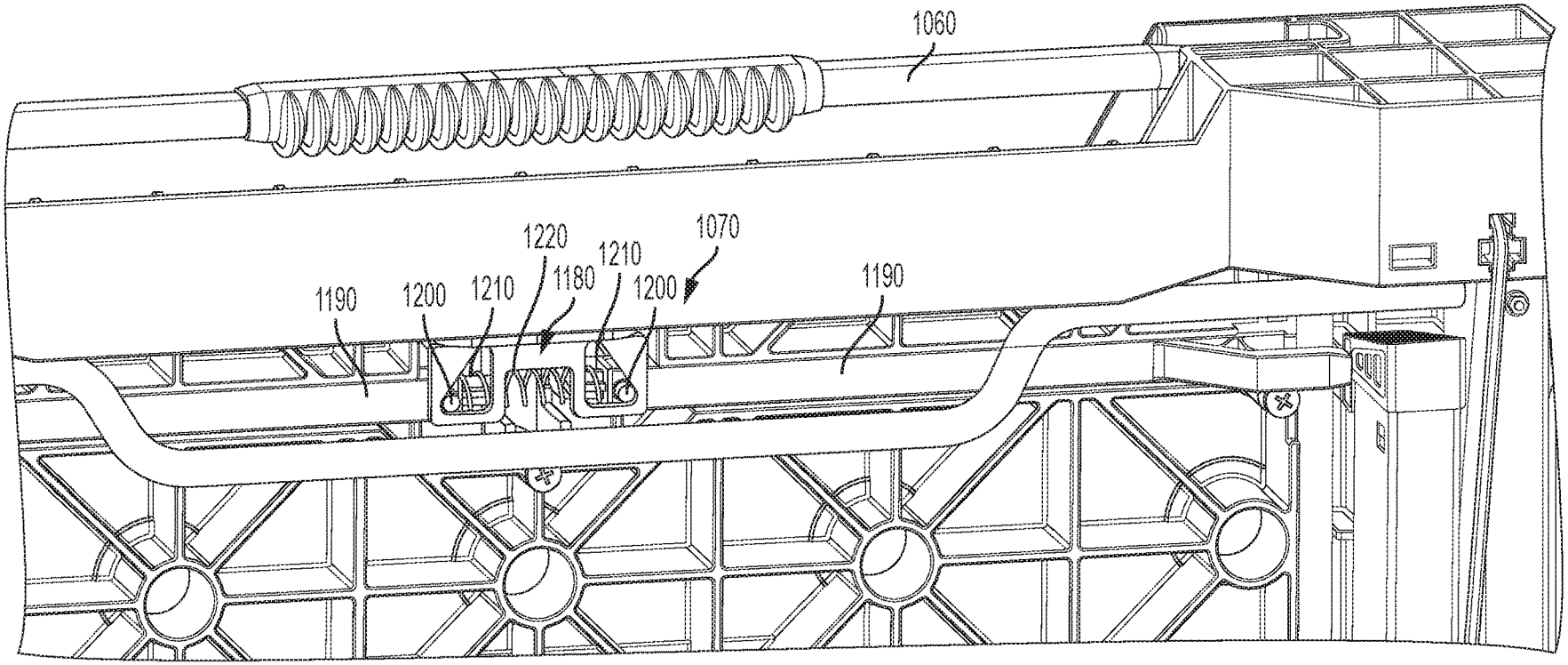
FIG. 14 illustrates a bottom perspective view of the handle and leg lock mechanism coupled to the leg lock button of FIG. 13.

As noted above, in an embodiment, the workbench 1000 may include a leg latch mechanism 1070 which may selectively lock the legs 1050 and movement of the handle 1060. FIG. 13 illustrates an isolated perspective view of an exterior facing actuator button 1170 of the leg latch mechanism. In an embodiment, such as that illustrated, pressing the actuator button 1170 may facilitate movement of the handle 1060 and unfolding of the legs 1050 as described below. Specifically, as illustrated in FIG. 14, the actuator button 1170 may be coupled to a locking lever retractor 1180, which may itself be coupled to a pair of locking levers 1190. As may be appreciated from FIG. 14, in an embodiment each locking lever 1190 may include an associated retractor pin 1200, which may be received in a ramped (e.g., triangular) region 1210 of the locking lever retractor 1180. Accordingly, pressing the actuator button 1170 may pull the retractor pins 1200 and thus the locking levers 1190 closer together as the actuator button 1170 and thus the locking lever retractor 1180 is pressed further into the work support structure 1010. As shown, in an embodiment, the locking levers 1190 may be coupled by a spring 1220 which may bias the locking levers 1190 apart, and thus would bias the locking lever retractor 1180 and thus the actuator button 1170 outward.

Figure 15:
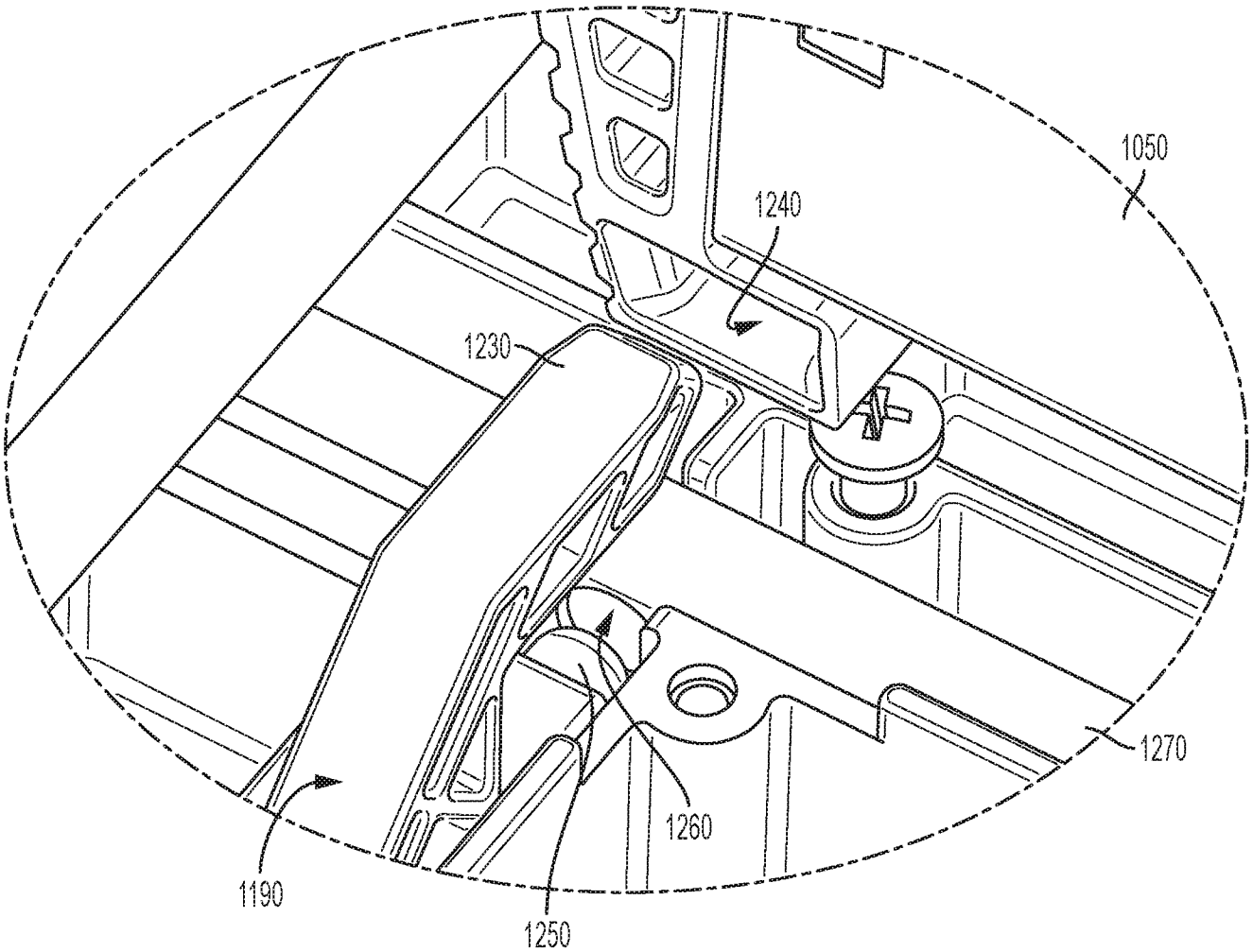
FIG. 15 illustrates an isolated perspective view of an engagement between the leg lock mechanism and a leg of the embodiment of FIGS. 10A-B.

Engagement between the locking levers 1190 and the legs 1050 may be appreciated in greater detail with reference to FIG. 15. Specifically, as shown in FIG. 15, when the legs 1050 are in the folded position a bottom portion thereof may be positioned adjacent to a leg engagement protrusion 1230 on the locking lever 1190, such that the leg engagement protrusion 1230 may selectively extend into or retract from a leg latch aperture 1240 on the leg 1050 (e.g., on a leg cap thereof). Accordingly, when the legs 1050 are in the folded position the leg engagement protrusion 1230 prevents the legs 1050 from pivoting away from the work support structure 1010. As further shown in FIG. 15, when the legs are in the folded position, a handle lock pin 1250 may align with and selectively engage with a handle lock aperture 1260 formed on a portion 1270 of the handle 1060 extending into the work support structure 1010 that couples to the rack and pinion system 1100. Accordingly, when the locking lever 1190 is in the locked position (e.g., the spring biased lock position in embodiments with the spring 1220), the handle lock pin 1250 engages the handle lock aperture 1260 to prevent sliding movement of the handle 1060, while the leg engagement protrusion 1230 engages the leg latch aperture 1240 further preventing unfolding of the legs 1050.

Figure 16A:
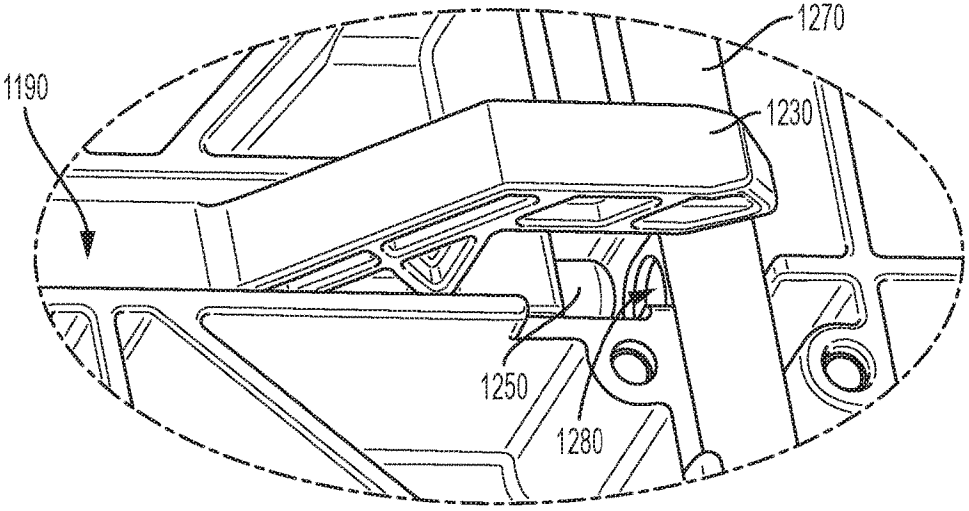
FIGS. 16A-B illustrates an isolated perspective views of the leg lock mechanism in unlocked and locked positions respectively.
Figure 16B:
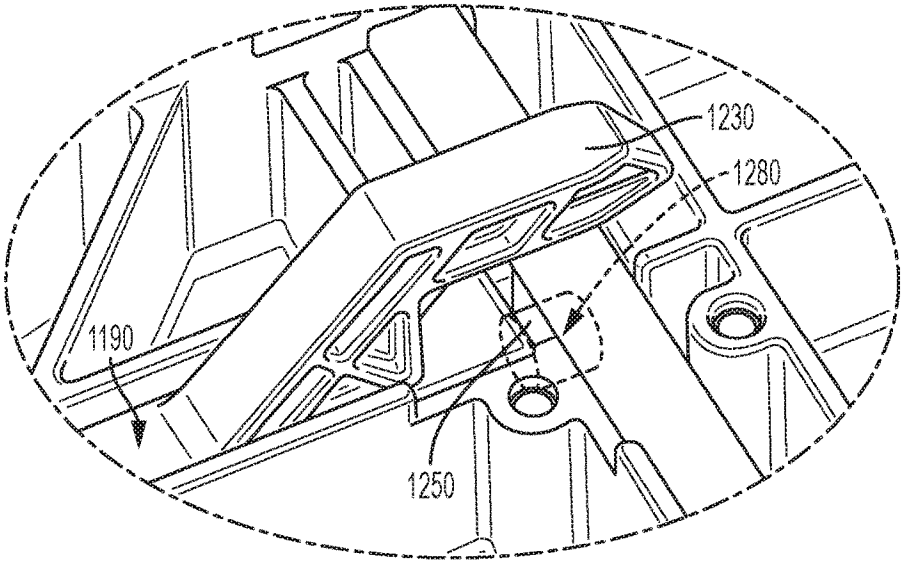

As shown in FIG. 16A and FIG. 16B, it may further be appreciated that a secondary handle lock aperture 1280 may also be formed on the portion 1270 of the handle 1060, aligned so that when the handle 1060 and the legs 1050 are fully extended from the work support structure 1010, the handle lock pin 1250 may engage the secondary handle lock aperture 1280 to lock the legs 1050 into the open position until the actuator button 1170 is pressed, again retracting the locking levers 1190 and thus the locking pins 1250 from the secondary handle lock aperture 1280. It may be appreciated that the features described herein may be duplicated on opposing sides of the workbench 1000, such that opposing locking pins 1250 on opposing locking levers 1190 may be utilized in some embodiments. It may be appreciated that in other embodiments a single locking lever 1190 may be configured to engage with one or more of leg latch aperture 1240, handle lock aperture 1260, and secondary handle lock aperture 1280 on one side of the workbench 1000.

It may therefore be appreciated that in in some embodiments, the leg latch mechanism 1070 of the workbench 1000 may include one or more of three disparate mechanisms of holding the legs 1050 folded into the work support structure 1010. Specifically, the legs 1050 may be locked by the engagement between the locking pin 1250 into the handle lock aperture 1260, the legs 1050 may be locked by the engagement of the leg engagement protrusion 1230 into the leg latch aperture 1240, and/or, in some embodiments the cross bar between the wider set of legs 1050 may be over lapped by the narrow legs 1050, as shown above with reference to FIG. 10B and FIG. 11, further securing both sets of legs 1050 through the associated engagements of the leg latch mechanism 1070.

It may be appreciated that a number of accessories may be received in the holes 1020, slots 1030, side holes 1040, or other lips, ridges, or apertures in the work bench 1000 or other workbench embodiments disclosed herein. For example, clamps, bench dogs, bins, trays, clamp holders, tool holders, hooks, vacuum holders, lamps, phone stands, paper clips, organizers (e.g., plastic, metal, or cloth construction, which may hang from or extend from the workbench with a vertical or horizontal organizer space opening) may be provided in various embodiments.

Figure 17B:
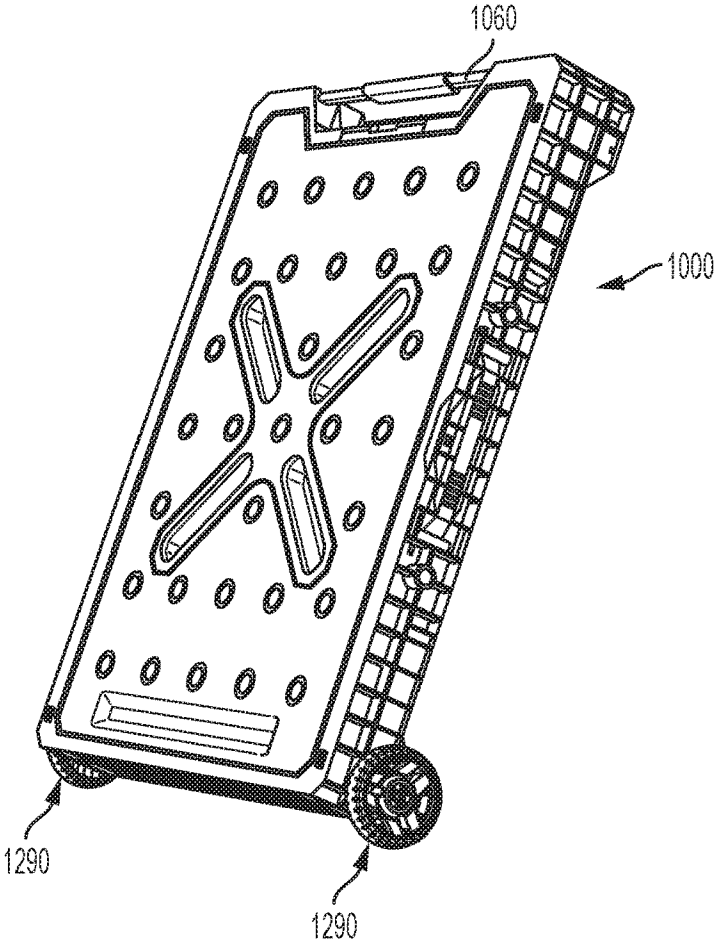
FIG. 17B illustrates a perspective view of an embodiment of the workbench of FIG. 17A having a pair of the wheels assembled thereon.
Figure 17A:
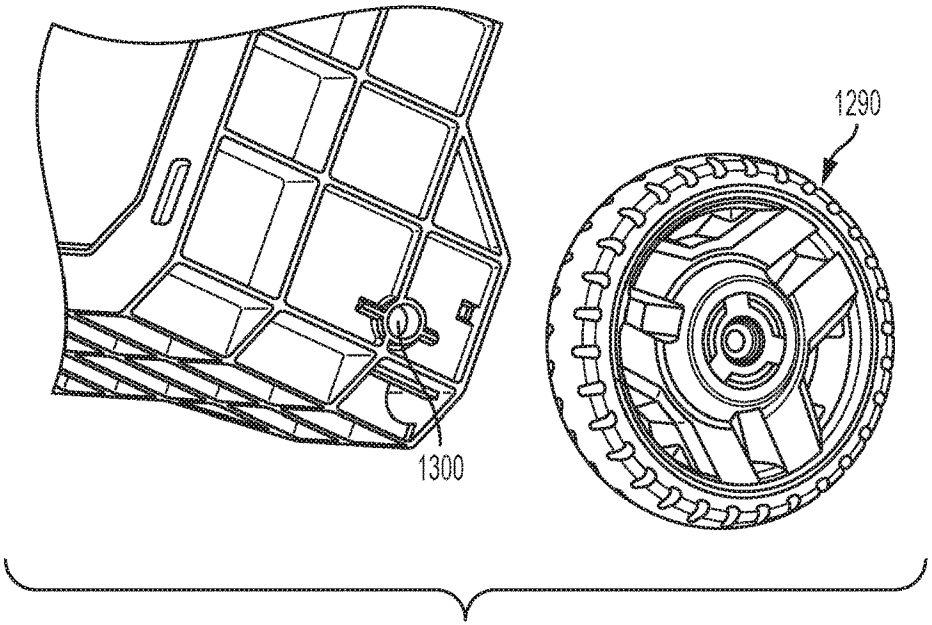
FIG. 17A illustrates an isolated perspective view of a wheel attachment aperture on an embodiment of the workbench of FIGS. 10A-B and a wheel positioned for assembly thereon.

In an embodiment the workbench 1000 may include a receptacle for an optional wheel accessory. For example, as shown in FIG. 17A and FIG. 17B, a wheel 1290 may be secured onto a wheel axle aperture 1300 at an end of the workbench 1000. In an embodiment, the wheel 1290 may include its own axle that snaps or otherwise affixes into the wheel axle aperture 1300, while in other embodiments the wheel 1290 may snap into an axle extending from the wheel axle aperture 1300. Accordingly, as shown in FIG. 17B, where a pair of wheels 1290 affixed to the workbench 1000 may facilitate rolling the workbench 1000 thereon. In an embodiment, the wheel axle apertures 1300 may be distal from the handle 1060, such that a user may maneuver the workbench 1000 on the wheels 1290 through engagement with the handle 1060.

Figure 18:
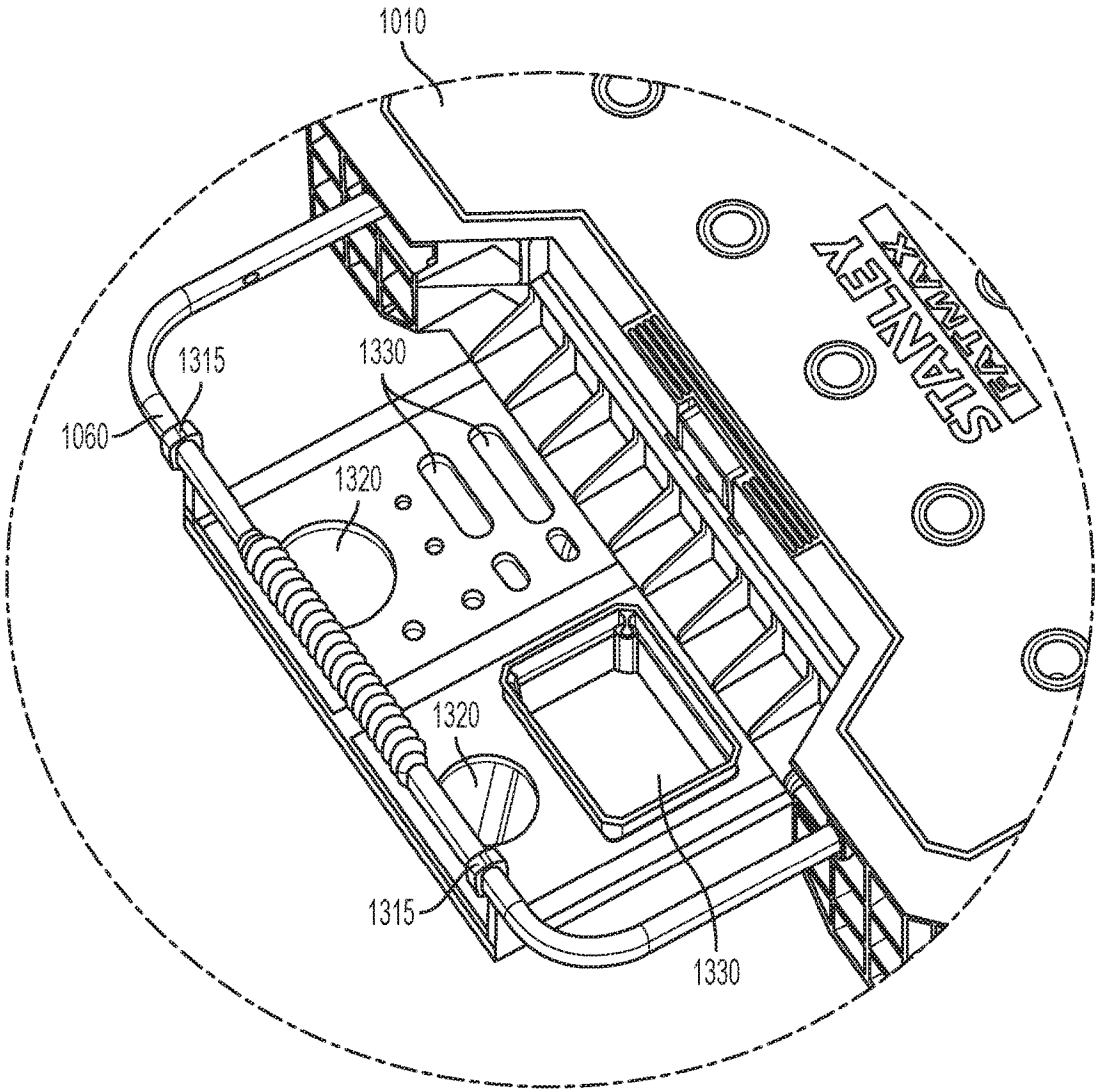
FIG. 18 illustrates an embodiment of the workbench of FIGS. 10A-B with an accessory tray mounted to the slidable handle.

It may be appreciated that the coupling of the handle 1060 to the rack and pinion system 1100 may provide sufficient support such that the handle 1060 extending out from the portions 1270 inside the work support structure 1010 may have sufficient strength to permit tools to hang therefrom. As shown in FIG. 18, in an embodiment, the workbench 1000 may include a tray 1310 which may hang from the handle 1060, and may include further apertures, grooves, or so on therein. In an embodiment, the tray 1310 may be slidable relative to the work support structure 1010, such that it extends from the work support structure 1010 when the handle 1060 and the legs 1050 are extended, but retracts into the work support structure 1010 with the handle 1060 and the legs 1050 when the handle 1060 is retracted. In an embodiment the work support structure 1010 may include rails on which the tray 1310 hangs to support the tray 1310 underneath the work support structure 1010, and may include hooks 1315 to hold an opposite end of the tray 1310 to the handle 1060. As shown, in an embodiment the tray 1310 may include one or more of holes 1320, slots 1330, and organizer cups 1340, which in some embodiments may be removable from the tray 1310.

It may be appreciated that any of the components discussed in the workbenches of the present application may be formed from any appropriate material in various embodiments, including metals, plastics, and combinations thereof. Additionally, in some embodiments components described above may be assemblies of subcomponents. Additionally, various components may be formed integral to one another. Assemblies of components together may be by any appropriate mechanism, including but not limited to adhesion, welds, snap fit, and fastening with fasteners (including but not limited to bolts, screws, rivets, etc.). Other modifications to the disclosure herein provided may be understood as being within the scope of claims enabled by this disclosure.

We claim:

1. A workbench comprising:

a work support structure;

a first leg member pivotable between a first position where said first leg member is folded against said work support structure and a second position where said first leg member extends downwardly from and supports said work support structure;

a second leg member pivotable between a first position where said second leg member is folded against said work support structure and a second position where said second leg member extends downwardly from and supports said work support structure;

a handle; and a rack and pinion system coupling the first leg member, the second leg member, and the handle;

wherein moving the handle relative to the work support structure drives both the first leg member and the second leg member to pivot between the first position and the second position via movement in the rack and pinion system.

2. The workbench recited in claim 1, said first leg member and said second leg member each comprising a pair of legs connected by a crossbar, wherein a crossbar of said first leg member is overlapped by the second leg member when the first leg member and the second member are in said first position.

3. The workbench recited in claim 1 further comprising a handle lock pin selectively retractable from a handle lock aperture formed on the handle and configured to secure one or both of said first leg member and said second leg member in at least one of said first position or said second position.

4. The workbench recited in claim 1 further comprising a plurality of apertures formed in the work support structure configured to receive one or more of clamps or accessories therethrough.

5. A workbench comprising:

a work support structure having two side surfaces and two end surfaces;

a first pair of slots, each slot of said first pair formed on opposite side surfaces adjacent one end surface;

a second pair of slots, each slot of said second pair formed on opposite side surfaces adjacent the other end surface;

a first leg member pivotally connected to said work support structure, said first leg member pivotable between a folded position in which said first leg member is substantially folded against said work support structure and a support position in which first leg member is extended substantially away from said work support structure;

a second leg member pivotally connected to said work support structure, said second leg member pivotable between a folded position in which said second leg member is substantially folded against said work support structure and a support position in which second leg member is extended substantially away from said work support structure, said first leg member and said second leg member jointly supporting said work support structure when in the support position;

a first arm linked by a first pivot limit bar to said first leg member and having a first toothed bar;

a second arm linked by a second pivot limit bar to said second leg member and having a second toothed bar; and a pinion gear disposed in engagement with both said first toothed bar and said second toothed bar; wherein, when either one of said first leg member or said second leg member is moved between said folded position or said support position to the other of said folded position or said support position, the other of said first leg member or said second leg member is caused to move to the same one of said folded position or said support position, and wherein said first pivot limit bar is movably disposed in said first pair of slots and is connected to both said first leg member and said first arm; and said second pivot limit bar is movably disposed in said second pair of slots and is connected to both said second leg member and said second arm.

6. The workbench recited in claim 5, wherein;

said first leg member comprises a first pair of legs and a first pivot bar extending between said first pair of legs and around which said first leg member may be pivoted between said folded position and said support position; and said second leg member comprises a second pair of legs and a second pivot bar extending between said second pair of legs and around which said second leg member may be pivoted between said first folded position and said support position.

7. The workbench recited in claim 5 further comprising:

a strap connected to one of said first pivot limit bar and said second pivot limit bar, wherein, a user may pull said strap and simultaneously move both said first leg member and said second leg member from said support position to said folded position.

8. The workbench recited in claim 5 further comprising:
an aperture formed in said first leg member; and
a latch including an actuator and a catch, said catch extending from said work support structure and into said aperture when said first leg member is in the folded position to lock said first leg member in said folded position; wherein,
actuation of said actuator removes said catch from said aperture to allow said first leg member to be moved to the support position.

9. The workbench recited in claim 5 further comprising:
an arm aperture disposed in said first arm;
a latch including an actuator and a catch, said catch extending from said work support structure and into said arm aperture when said first leg member is in the support position to lock said first leg member in said support position; wherein,
actuation of said actuator removes said catch from said arm aperture to allow said first leg member to be moved to the folded position.

10. The workbench recited in claim 9 further comprising:
a leg member aperture formed in said first leg member; and
a second catch included in said latch, said second catch extending from said work support structure and into said leg member aperture when said first leg member is in the folded position to lock said first leg member in the folded position; wherein,
actuation of said actuator removes said second catch from said leg member aperture to allow said first leg member to be moved to the support position.

11. The workbench recited in claim 10 further comprising:
a rotatable shaft; wherein,
said catch and said second catch are disposed on and rotate with said shaft, said shaft spring biased to bias said catch in a first position in which said catch may be received in said arm aperture and to bias said second catch in a second position in which said second catch may be received in said first leg member aperture, said actuator comprising a push button which may be pushed to rotate said shaft against the spring bias to rotate said catch away from the first position and said second catch away from the second position.

12. The workbench recited in claim 1 wherein:
said handle is slidably disposed between a first handle position and a second handle position relative to said work support structure, said handle linked to said first leg member; wherein,
when said handle is in the first handle position, said first leg member and said second leg member are in their said first positions, and when said handle is in the second handle position, said first leg member and said second leg member are in their said second positions, and movement of said handle between the first handle position and the second handle position causes corresponding movement of said first leg member and said second leg member between their first positions and their second positions.

13. The workbench recited in claim 12 further comprising:
two side surfaces forming part of said work support structure, said handle extending from a first of said side surfaces; and
a first wheel and a second wheel disposed at a second of said side surfaces and linked to said second leg member, said first wheel and said second wheels slidably disposed between a first wheel position where said wheels include at least a portion thereof extending outward of said work support surface and a second wheel position where said wheels are beneath said work support surface, said wheels moving between the first wheel position and the second wheel position due to movement of said handle between the first handle position and the second handle position.

14. A workbench comprising:
a work support having a work support surface, first and second end surfaces extending downwardly from said work support surface, and first and second side surfaces extending downwardly from said work support surface;
a first pair of grooves, a first groove of said first pair of grooves formed in said first side surface and a second groove of said first pair of grooves formed in said second side surface and opposite said first groove formed in said first side surface;
a second pair of grooves, a first groove of said second pair of grooves formed in said first side surface and a second groove of said second pair of grooves formed in said second side surface and opposite said first groove formed in said second side surface;
a first axle slidably supported in said first pair of grooves;
a second axle slidably supported in said second pair of grooves;
a first leg member supported by and pivotable about said first axle between a folded position wherein said first leg member is folded adjacent said work support surface and a support position wherein said first leg member is disposed downwardly from said work support surface to support said work support structure;
a second leg member supported by and pivotable about said second axle between a folded position wherein said second leg member is folded adjacent said work support surface and a support position wherein said second leg member is disposed downwardly from said work support surface to support said work support;
a handle extending from one of said end surfaces and slidably disposed relative to said work support between first and second handle positions;
a first rack bar including a rack and connected to said first axle;
a second rack bar including a rack and connected to both said second axle and said handle; and
a pinion gear disposed between and in engagement with said racks; wherein
when said handle is moved between the first and second handle positions, said second rack bar moves in a first direction and rotates said pinion gear to cause said first rack bar to move in a second opposite direction, the movement of said first rack bar causing said first axle to slide along said first pair of grooves and the movement of said second rack bar causing said second axle to slide along said second pair of grooves in an opposite direction to thereby cause said first leg member and said second leg member to both pivot towards either the folded position or the support position.

15. The workbench recited in claim 14 further comprising:
a third rack bar including a rack and connected to said first axle;
a fourth rack bar including a rack and connected to both said second axle and said handle;
a second pinion gear, said second pinion gear disposed between and in engagement with said rack of said third rack bar and said rack of said fourth rack bar; wherein, when said handle is moved between the first and second handle positions, said fourth rack bar moves in the first direction and rotates said second pinion gear to cause said third rack bar to move in the second opposite direction, the movement of said third rack bar causing said first axle to slide along said first pair of grooves and the movement of said fourth rack bar causing said second axle to slide along said second pair of grooves in an opposite direction to thereby cause said first leg member and said second leg member to both pivot towards either the folded position or the support position.

16. The workbench recited in claim 14 further comprising:

an aperture formed in one of said first and said second leg members;

a locking shaft including a leg engagement protrusion formed at a laterally outward end, said locking shaft having a laterally inward end;

a spring disposed adjacent said laterally inward end and biasing said locking shaft laterally outwardly such that said leg engagement protrusion engages said aperture to lock said one of said first and said second leg members in the folded position; and an actuator including a surface in contact with said locking shaft, said actuator biased outwardly when said leg engagement protrusion engages said aperture, and wherein, said actuator may be pushed to overcome the bias and simultaneously withdraw said leg engagement protrusion from said aperture to allow said first and second leg members to be moved to the support position.

17. The workbench recited in claim 16 further comprising:

a locking pin disposed at said laterally outward end; and a handle aperture formed in said handle; wherein, when said first and second leg members are in the folded position, said locking pin is biased into said handle aperture to preclude movement of said handle between said first and second handle positions.

18. The workbench recited in claim 16 further comprising:

a locking pin disposed at said laterally outward end, a handle aperture formed in said handle; wherein, when said first and second leg members are in the support position, said locking pin is biased into said handle aperture to preclude movement of said handle between said first and second handle positions.

19. The workbench recited in claim 1, wherein said rack and pinion system includes a rack and a pinion gear, and said handle is mechanically linked to said rack independently of said pinion gear.

20. The workbench recited in claim 1, wherein, said handle is mechanically linked to said first leg member independently of said rack and pinion system.

* * * * *